US010961462B2

(12) United States Patent
McDade

(10) Patent No.: US 10,961,462 B2
(45) Date of Patent: Mar. 30, 2021

(54) PROCESS FOR EXTRACTING LIGHT HYDROCARBONS FROM AGGREGATE MATERIAL

(71) Applicant: Billy Shane McDade, Austin, TX (US)

(72) Inventor: Billy Shane McDade, Austin, TX (US)

( * ) Notice: Subject to any disclaimer, the term of this patent is extended or adjusted under 35 U.S.C. 154(b) by 0 days.

(21) Appl. No.: 16/723,104

(22) Filed: Dec. 20, 2019

(65) Prior Publication Data

US 2020/0199456 A1 Jun. 25, 2020

Related U.S. Application Data

(60) Provisional application No. 62/782,682, filed on Dec. 20, 2018, provisional application No. 62/840,016, filed on Apr. 29, 2019.

(51) Int. Cl.

| | |
|---|---|
| ***C10G 1/04*** | (2006.01) |
| ***C10G 1/00*** | (2006.01) |
| ***C10G 1/02*** | (2006.01) |
| ***C10C 3/00*** | (2006.01) |
| ***C10C 3/06*** | (2006.01) |
| ***C10C 3/08*** | (2006.01) |

(52) U.S. Cl.

CPC ..... *C10G 1/045* (2013.01); *C10C 3/002* (2013.01); *C10C 3/007* (2013.01); *C10C 3/06* (2013.01); *C10C 3/08* (2013.01); *C10G 1/002* (2013.01); *C10G 1/006* (2013.01); *C10G 1/02* (2013.01); *C10G 2300/208* (2013.01); *C10G 2300/4006* (2013.01)

(58) Field of Classification Search

None

See application file for complete search history.

(56) References Cited

U.S. PATENT DOCUMENTS

| | | | | |
|---|---|---|---|---|
| 4,008,147 | A * | 2/1977 | Kondo | C10G 9/26 208/126 |
| 7,318,891 | B1 * | 1/2008 | Malone | C10C 1/19 208/131 |
| 9,475,960 | B2 * | 10/2016 | Trewella | C10G 3/42 |
| 2002/0179493 | A1 * | 12/2002 | Etter | C10B 55/00 208/131 |
| 2012/0091043 | A1 * | 4/2012 | Stiller | C10L 10/10 208/435 |
| 2015/0368393 | A1 * | 12/2015 | Werker | C08K 5/005 524/599 |
| 2016/0045841 | A1 * | 2/2016 | Kaplan | B01D 3/06 429/49 |
| 2017/0253737 | A1 * | 9/2017 | Auld | C08J 3/126 |
| 2018/0023007 | A1 * | 1/2018 | Bartek | C10G 32/00 435/167 |
| 2018/0117561 | A1 * | 5/2018 | Brucato | A61L 11/00 |

* cited by examiner

*Primary Examiner* — Tam M Nguyen

(74) *Attorney, Agent, or Firm* — Buchanan Ingersoll & Rooney PC

(57) ABSTRACT

Disclosed is method that involves subjecting a base material to an extraction process to extract hydrocarbon fractions having molecular weights within a desired range from the base material to generate a resultant extraction material comprising mostly if not entirely of hydrocarbon fractions having molecular weights within the desired range. In some embodiments, the extraction process can involve performing the extraction in iterations.

11 Claims, 23 Drawing Sheets

Detailed Hydrocarbon Analysis Summary Report - Report Date: 10/17/2018 20:44:45

RawFile: \\Ww7uspas01acardio7900\Data\2018\OCT\USPAS-18-06188-001-D7900.0000.cdf
Sample: USPAS-18-06188-001-D7900
Processed 118 Peaks
Reference File: C:\LtEnds in Crude\Results\2018\OCT\531-1800071-001-D7900_10092018.DHA
Comments:

Acquired: 10/17/18 12:33:35
Analyzed: 10/17/2018 20:33:16

Yield: 67.364
Int Std: hexene-1
Int Std Amt: 0.206
Sample Wt: 10.081 Sample Den: 0.780

SUMMARY REPORT

| Group Type | Total(Mass%) | Total(Vol%) | Total(Mol%) |
|---|---|---|---|
| Paraffins: | 37.525 | 44.753 | 36.959 |
| i-Paraffins: | 10.515 | 12.698 | 10.280 |
| Olefins: | 0.093 | 0.092 | 0.079 |
| Napthenes: | 18.596 | 19.254 | 18.490 |
| Aromatics: | 0.081 | 0.073 | 0.085 |
| Total C14+: | 0.000 | 0.000 | 0.000 |
| Total Unknowns: | 0.056 | 0.062 | 0.123 |

Oxygenates:

Total: 0.000(Mass%) 0.000(Vol%)

Total Oxygen Content: 0.000(Mass%)

Multisubstituted Aromatics: 0.038(Mass%) 0.034(Vol%)

Average Molecular Weight: 83.444

Relative Density: 0.663

Reid Vapor Pressure @ 100F: 3.952

Calculated Octane Number: 47.324

Motor Octane Number (Jenkins Calculation): 47.535

| | IBP | T10 | T50 | T90 | FBP |
|---|---|---|---|---|---|
| BP by Mass (Deg F) | BP Distribution Not Calculated... | | | | |
| BP by Vol (Deg F) | BP Distribution Not Calculated... | | | | |

Percent Carbon: 84.192 Percent Hydrogen: 15.808

Bromine Number (Calc): 0.299

FIG. 6

Detailed Hydrocarbon Analysis Detail Report - Report Date: 10/17/2018 20:44:45

RawFile: \\Ws7uspas01acard\d7900\Data\2018\OCT\USPAS-18-06168-001-D7900.0000.cdf
Sample: USPAS-18-06168-001-D7900
Processed 118 Peaks
Reference File: C:\LIEnds in Crude\Results\2018\OCT\531-1800071-001-D7900_100620 18.DHA
Comments:

Acquired: 10/17/18 12:33:35
Analyzed: 10/17/2018 20:33:16

Yield: 57.364
Int Std: hexane-1
Int Std Amt: 0.206
Sample Wt: 15.081 Sample Den: 0.780

Molecular Weight and Relative Density Data

| Group | Avg Mw. | Avg Rel. Density |
|---|---|---|
| C1 | 0.000 | 0.000 |
| C2 | 30.070 | 0.340 |
| C3 | 44.097 | 0.501 |
| C4 | 58.124 | 0.579 |
| C5 | 72.151 | 0.625 |
| C6 | 85.597 | 0.683 |
| C7 | 99.936 | 0.693 |
| C8 | 112.833 | 0.735 |
| C9 | 125.441 | 0.770 |
| C10 | 141.421 | 0.752 |
| C11 | 0.000 | 0.000 |
| C12 | 0.000 | 0.000 |
| C13 | 0.000 | 0.000 |
| Total Sample: | 83.40 | 0.66 |

Octane Number

Research Octane Number: 47.30
*(Calculated from Individual Component Values)*

Contribution to Total by:

| | |
|---|---|
| Paraffins: | 10.30 |
| Iso-Paraffins: | 13.10 |
| Aromatics: | 0.13 |
| Napthenes: | 23.60 |
| Olefins: | 0.10 |
| Oxygenates: | 0.00 |

FIG. 7

Detailed Hydrocarbon Analysis Detail Report - Report Date: 10/17/2018 20:44:45

RawFile: \\Ww7uspas01acard\d7900\Data\2015\OCT\USPAS-18-06188-001-D7900.0000.cdf
Sample: USPAS-18-06188-001-D7900
Processed 118 Peaks
Reference File: C:\LtEnds In Crude\Results\2018\OCT\531-1808071-001-D7900_10192018.DHA
Comments:

Acquired: 10/17/15 12:33:35
Analyzed: 10/17/2018 20:33:16

Yield: 57.364
Int Std: hexene-1
Int Std Amt: 0.2559
Sample Wt: 10.0810 Sample Den: 0.750

Totals by Group Type & Carbon Number (in Mass Percent)

| | Paraffins | I-Paraffins | Olefins | Napthenes | Aromatics | Unknowns | Total |
|---|---|---|---|---|---|---|---|
| C1 | 0.00000 | 0.00000 | 0.00000 | 0.00000 | 0.00000 | 0.00000 | 0.00000 |
| C2 | 0.00020 | 0.00000 | 0.00000 | 0.00000 | 0.00000 | 0.00000 | 0.00020 |
| C3 | 0.00029 | 0.00000 | 0.00000 | 0.00000 | 0.00000 | 0.00000 | 0.00029 |
| C4 | 0.00032 | 0.00000 | 0.00000 | 0.00000 | 0.00000 | 0.00000 | 0.00032 |
| C5 | 0.00135 | 0.00032 | 0.00000 | 0.00000 | 0.00000 | 0.00000 | 0.00137 |
| C6 | 37.70538 | 8.75110 | 0.05816 | 18.31677 | 0.00099 | 0.00000 | 64.83239 |
| C7 | 0.07581 | 1.88763 | 0.02116 | 0.12576 | 0.03059 | 0.00196 | 2.14520 |
| C8 | 0.02038 | 0.07267 | 0.00000 | 0.02908 | 0.01560 | 0.00088 | 0.13861 |
| C9 | 0.01277 | 0.03188 | 0.00328 | 0.02844 | 0.02592 | 0.00158 | 0.09587 |
| C10 | 0.00868 | 0.07116 | 0.00000 | 0.01072 | 0.00741 | 0.04547 | 0.14346 |
| C11 | 0.00000 | 0.00000 | 0.00000 | 0.00000 | 0.00000 | 0.00569 | 0.00569 |
| C12 | 0.00000 | 0.00000 | 0.00000 | 0.00000 | 0.00000 | 0.00000 | 0.00000 |
| C13 | 0.00000 | 0.00000 | 0.00000 | 0.00000 | 0.00000 | 0.00000 | 0.00000 |
| Total: | 37.82473 | 10.81476 | 0.08261 | 18.53578 | 0.08051 | 0.05558 | 57.30872 |

Oxygenates 0.00000 Total C14+: 0.00000
Total Unknowns: 0.05558 Grand Total: 57.36430

Totals by Group Type & Carbon Number (in Volume Percent)

| | Paraffins | I-Paraffins | Olefins | Napthenes | Aromatics | Unknowns | Total |
|---|---|---|---|---|---|---|---|
| C1 | 0.00000 | 0.00000 | 0.00000 | 0.00000 | 0.00000 | 0.00000 | 0.00000 |
| C2 | 0.00046 | 0.00000 | 0.00000 | 0.00000 | 0.00000 | 0.00000 | 0.00046 |
| C3 | 0.00045 | 0.00000 | 0.00000 | 0.00000 | 0.00000 | 0.00000 | 0.00045 |
| C4 | 0.00029 | 0.00000 | 0.00000 | 0.00000 | 0.00000 | 0.00000 | 0.00029 |
| C5 | 0.00131 | 0.00040 | 0.00000 | 0.00000 | 0.00000 | 0.00000 | 0.00171 |
| C6 | 44.61556 | 10.31534 | 0.06598 | 19.06247 | 0.00088 | 0.00000 | 74.06024 |
| C7 | 0.08652 | 2.17981 | 0.02364 | 0.13115 | 0.02780 | 0.00218 | 2.45111 |
| C8 | 0.02264 | 0.08336 | 0.00000 | 0.02919 | 0.01404 | 0.00098 | 0.14722 |
| C9 | 0.01368 | 0.03444 | 0.00366 | 0.02040 | 0.02320 | 0.00176 | 0.09734 |
| C10 | 0.00928 | 0.07518 | 0.00000 | 0.01046 | 0.00678 | 0.05066 | 0.15236 |
| C11 | 0.00000 | 0.00000 | 0.00000 | 0.00000 | 0.00000 | 0.00635 | 0.00635 |
| C12 | 0.00000 | 0.00000 | 0.00000 | 0.00000 | 0.00000 | 0.00000 | 0.00000 |
| C13 | 0.00000 | 0.00000 | 0.00000 | 0.00000 | 0.00000 | 0.00000 | 0.00000 |
| Total: | 44.75339 | 12.68554 | 0.09328 | 19.25368 | 0.07270 | 0.06196 | 76.85858 |

Oxygenates 0.00000 Total C14+: 0.00000
Total Unknowns: 0.06196 Grand Total: 76.92054

FIG. 8

Detailed Hydrocarbon Analysis Detail Report - Report Date: 10/17/2018 20:44:45

RawFile: \\We7uspas0 (scanfid7900)\Data\2018\OCT\USPAS-18-06188-001-D7900.0000.cdf
Sample: USPAS-18-06188-001-D7900
Processed 118 Peaks
Reference File: C:\LiEnds In Crude\Results\2018\OCT\531-1800371-001-D7900_10092018.DHA
Comments:

Acquired: 10/17/18 12:33:35
Analyzed: 10/17/2018 20:33:16

Yield: 67.364
Int Std: hexane-1
Int Std Amt: 0.206
Sample Wt: 18.081 Sample Den: 0.780

Hold

Components Listed in Chromatographic Order Page: 4

| Minutes | Index | Group | Component | Mass % | Volume % | Mol % |
|---|---|---|---|---|---|---|
| 4.522 | 200.000 | P2 | ethane | 0.000 | 0.000 | 0.001 |
| 4.693 | 300.000 | P3 | propane | 0.000 | 0.000 | 0.001 |
| 5.187 | 400.000 | P4 | n-butane | 0.000 | 0.000 | 0.000 |
| 6.111 | 473.750 | I5 | i-pentane | 0.000 | 0.000 | 0.000 |
| 6.650 | 499.480 | P5 | n-pentane | 0.001 | 0.001 | 0.001 |
| 7.687 | 534.900 | I6 | 2,2-dimethylbutane | 0.002 | 0.002 | 0.002 |
| 8.560 | 556.670 | O6 | 4-methylpentene-1 | 0.001 | 0.001 | 0.001 |
| 8.998 | 564.140 | I6 | 2,3-dimethylbutane | 0.101 | 0.119 | 0.099 |
| 9.100 | 566.240 | I6 | 2-methylpentane | 1.767 | 2.111 | 1.727 |
| 9.966 | 582.320 | I6 | 3-methylpentane | 8.981 | 6.093 | 8.728 |
| 11.013 | 600.000 | P6 | n-hexane | 37.785 | 44.619 | 36.864 |
| 11.196 | 603.290 | O6 | t-hexene-2 | 0.033 | 0.038 | 0.033 |
| 11.566 | 609.920 | O6 | 3-methyl-c-pentene-2 | 0.016 | 0.018 | 0.016 |
| 11.851 | 614.240 | O6 | c-hexene-2 | 0.009 | 0.010 | 0.009 |
| 12.299 | 621.210 | O7 | 3,3-dimethylpentene-1 | 0.005 | 0.006 | 0.004 |
| 12.606 | 625.760 | I7 | 2,2-dimethylpentane | 0.877 | 1.016 | 0.738 |
| 12.926 | 628.820 | N6 | methylcyclopentane | 17.569 | 18.313 | 17.589 |
| 13.091 | 632.620 | I7 | 2,4-dimethylpentane | 0.698 | 0.798 | 0.578 |
| 13.472 | 637.730 | I7 | 2,2,3-trimethylbutane | 0.077 | 0.089 | 0.065 |
| 14.445 | 649.880 | -- | unknown | 0.001 | 0.001 | 0.002 |
| 14.631 | 652.070 | A6 | benzene | 0.001 | 0.001 | 0.001 |
| 14.930 | 655.500 | -- | unknown | 0.001 | 0.001 | 0.003 |
| 15.153 | 658.010 | I7 | 3,3-dimethylpentane | 0.039 | 0.043 | 0.032 |
| 15.455 | 661.310 | N6 | cyclohexane | 0.748 | 0.749 | 0.749 |
| 16.387 | 670.760 | I7 | 2-methylhexane | 0.077 | 0.088 | 0.065 |
| 16.495 | 672.030 | I7 | 2,3-dimethylpentane | 0.032 | 0.036 | 0.027 |
| 16.723 | 674.250 | O7 | 5-methyl-t-hexene-2 | 0.016 | 0.018 | 0.014 |
| 17.193 | 678.720 | I7 | 3-methylhexane | 0.089 | 0.101 | 0.075 |
| 17.781 | 683.890 | N7 | 1c,3-dimethylcyclopentane | 0.007 | 0.008 | 0.006 |
| 18.036 | 686.330 | N7 | 1t,3-dimethylcyclopentane | 0.006 | 0.006 | 0.005 |
| 18.204 | 687.770 | I7 | 3-ethylpentane | 0.009 | 0.010 | 0.007 |
| 18.312 | 688.700 | N7 | 1t,2-dimethylcyclopentane | 0.006 | 0.007 | 0.005 |
| 19.605 | 700.000 | P7 | n-heptane | 0.076 | 0.087 | 0.064 |
| 19.937 | 702.740 | -- | unknown | 0.000 | 0.000 | 0.001 |
| 21.719 | 721.740 | N7 | methylcyclohexane | 0.106 | 0.107 | 0.091 |
| 22.085 | 725.430 | I8 | 2,2-dimethylhexane | 0.005 | 0.006 | 0.004 |
| 23.049 | 734.690 | N7 | ethylcyclopentane | 0.004 | 0.004 | 0.003 |
| 23.259 | 736.640 | I8 | 2,5-dimethylhexane | 0.004 | 0.004 | 0.003 |

FIG. 9

Detailed Hydrocarbon Analysis Detail Report - Report Date: 10/17/2018 23:44:45

RawFile: \\Ws7uspas01acard\d7900\Data\2018\OCT\USPAG-18-06188-001-D7900.0000.cdf Acquired: 10/17/18 12:33:35
Sample: USPAG-18-06188-001-D7900 Analyzed: 10/17/2018 23:33:16
Processed 115 Peaks
Reference File: C:\LSEnds In Grade\Results\2018\OCT\531-1800371-001-D7900_10192018.DHA
Comments: Yield: 67.354
Int Std: hexane-1
Int Std Amt: 0.205
Field Sample Wt: 10.081 Sample Den: 0.780

Components Listed in Chromatographic Order Page: 5

| Minutes | Index | Group | Component | Mass % | Volume % | Mol % |
|---|---|---|---|---|---|---|
| 23.470 | 738.580 | IS | 2,4-dimethylhexane | 0.006 | 0.007 | 0.004 |
| 24.105 | 744.310 | NS | 1c,2t,4-trimethylcyclopentane | 0.002 | 0.002 | 0.002 |
| 24.222 | 745.340 | IS | 3,3-dimethylhexane | 0.003 | 0.004 | 0.003 |
| 24.885 | 751.100 | NS | 1t,2c,3-trimethylcyclopentane | 0.001 | 0.001 | 0.000 |
| 25.651 | 757.520 | A7 | toluene | 0.031 | 0.028 | 0.028 |
| 26.589 | 765.080 | IS | 2,3-dimethylhexane | 0.003 | 0.003 | 0.002 |
| 26.637 | 765.440 | IS | 2-methyl-3-ethylpentane | 0.006 | 0.006 | 0.004 |
| 27.318 | 770.720 | IS | 2-methylheptane | 0.010 | 0.011 | 0.007 |
| 27.467 | 772.000 | IS | 4-methylheptane | 0.006 | 0.006 | 0.004 |
| 27.719 | 773.740 | IS | 3,4-dimethylhexane | 0.001 | 0.001 | 0.001 |
| 28.220 | 777.470 | IS | 3-methylheptane | 0.013 | 0.015 | 0.010 |
| 28.301 | 778.060 | IS | 3-ethylhexane | 0.016 | 0.017 | 0.012 |
| 28.529 | 779.720 | NS | 1t,4-dimethylcyclohexane | 0.004 | 0.004 | 0.003 |
| 29.394 | 786.870 | -- | unknown | 0.000 | 0.001 | 0.001 |
| 30.046 | 790.380 | NS | 2t-ethylmethylcyclopentane | 0.001 | 0.001 | 0.001 |
| 30.650 | 794.450 | NS | 1t,2-dimethylcyclohexane | 0.004 | 0.004 | 0.003 |
| 31.497 | 800.000 | PS | n-octane | 0.020 | 0.023 | 0.015 |
| 33.653 | 820.200 | NS | N2 | 0.000 | 0.000 | 0.000 |
| 34.395 | 826.800 | NS | 1c,2-dimethylcyclohexane | 0.006 | 0.006 | 0.005 |
| 35.040 | 832.420 | NS | n-propylcyclopentane | 0.011 | 0.011 | 0.008 |
| 35.205 | 833.840 | IS | 2,4-dimethylheptane | 0.002 | 0.002 | 0.001 |
| 35.720 | 838.210 | IS | 4,4-dimethylheptane | 0.002 | 0.002 | 0.001 |
| 36.020 | 840.730 | IS | 2,5-dimethylheptane | 0.002 | 0.002 | 0.001 |
| 37.269 | 850.950 | AS | ethylbenzene | 0.002 | 0.002 | 0.002 |
| 37.595 | 853.550 | IS | I3 | 0.003 | 0.003 | 0.002 |
| 37.971 | 856.520 | IS | I4 | 0.001 | 0.001 | 0.001 |
| 38.087 | 857.430 | OS | 2-methyloctene-2 | 0.001 | 0.002 | 0.001 |
| 38.346 | 859.450 | AS | 1,3-dimethylbenzene | 0.007 | 0.007 | 0.006 |
| 38.494 | 860.600 | AS | 1,4-dimethylbenzene | 0.003 | 0.003 | 0.002 |
| 38.546 | 860.990 | IS | 2,3-dimethylheptane | 0.002 | 0.002 | 0.001 |
| 39.189 | 865.920 | IS | I5 | 0.001 | 0.001 | 0.000 |
| 39.562 | 868.740 | IS | 4-methyloctane | 0.003 | 0.003 | 0.002 |
| 39.699 | 869.870 | IS | 2-methyloctane | 0.004 | 0.004 | 0.002 |
| 40.112 | 872.830 | NS | 1c,2t,3c-trimethylcyclohexane | 0.005 | 0.005 | 0.003 |
| 40.408 | 875.010 | IS | 3-ethylheptane | 0.002 | 0.002 | 0.001 |
| 40.513 | 875.780 | IS | 3-methyloctane | 0.007 | 0.007 | 0.004 |
| 40.982 | 879.040 | -- | unknown | 0.002 | 0.002 | 0.004 |
| 41.119 | 880.180 | AS | 1,2-dimethylbenzene | 0.003 | 0.002 | 0.002 |

FIG. 10

Detailed Hydrocarbon Analysis Detail Report - Report Date: 10/17/2018 20:44:45

RawFile: \\Ww7uspas01acard\d7900\Data\2018\OCT\USPAS-18-06188-001-D7900.0000.cdf Acquired: 10/17/18 12:33:35
Sample: USPAS-18-06188-001-D7900 Analyzed: 10/17/2018 20:33:16
Processed 118 Peaks
Reference File: C:\LtEnds in Crude\Results\2018\OCT\531-1600071-001-D7900_10092018.DHA
Comments: Yield: 57.364
Int Std: hexane-1
Int Std Amt: 0.206
Hold Sample Wt: 10.051 Sample Den: 0.780

Components Listed in Chromatographic Order Page: 6

| Minutes | Index | Group | Component | Mass % | Volume % | Mol % |
|---|---|---|---|---|---|---|
| 41.345 | 881.790 | I9 | I7 | 0.001 | 0.001 | 0.001 |
| 41.921 | 885.880 | N9 | N19 | 0.001 | 0.001 | 0.001 |
| 42.037 | 886.670 | N9 | N20 | 0.006 | 0.006 | 0.004 |
| 42.324 | 888.680 | I9 | I8 | 0.004 | 0.004 | 0.002 |
| 42.502 | 889.910 | I9 | I9 | 0.001 | 0.001 | 0.000 |
| 43.986 | 900.030 | P9 | n-nonane | 0.013 | 0.014 | 0.008 |
| 44.386 | 903.710 | N9 | N24 | 0.003 | 0.003 | 0.002 |
| 44.753 | 907.090 | O9 | t-nonene-3 | 0.001 | 0.001 | 0.001 |
| 45.667 | 915.540 | N9 | N27 | 0.001 | 0.001 | 0.001 |
| 45.938 | 917.770 | O9 | -[1] | 0.001 | 0.001 | 0.000 |
| 46.110 | 919.300 | -- | unknown | 0.001 | 0.001 | 0.002 |
| 47.028 | 927.340 | I10 | -[8] | 0.002 | 0.002 | 0.001 |
| 47.258 | 929.330 | I10 | -[9] | 0.004 | 0.005 | 0.003 |
| 47.794 | 933.920 | N9 | -[10] | 0.005 | 0.005 | 0.003 |
| 48.321 | 938.380 | I10 | -[14] | 0.003 | 0.003 | 0.002 |
| 48.889 | 943.130 | A9 | n-propylbenzene | 0.001 | 0.001 | 0.001 |
| 49.156 | 945.340 | -- | unknown | 0.001 | 0.002 | 0.004 |
| 49.895 | 950.680 | A9 | 1,3-methylethylbenzene | 0.002 | 0.002 | 0.002 |
| 50.022 | 952.410 | A9 | 1,4-methylethylbenzene | 0.003 | 0.002 | 0.002 |
| 50.534 | 956.540 | -- | unknown | 0.001 | 0.001 | 0.003 |
| 50.761 | 958.350 | A9 | 1,3,5-trimethylbenzene | 0.003 | 0.002 | 0.002 |
| 50.896 | 959.430 | -- | unknown | 0.001 | 0.001 | 0.001 |
| 51.790 | 966.380 | I10 | 5-methylnonane | 0.046 | 0.049 | 0.027 |
| 51.933 | 967.590 | A9 | 1,2-methylethylbenzene | 0.001 | 0.001 | 0.001 |
| 52.354 | 970.630 | I10 | 2-methylnonane | 0.001 | 0.001 | 0.001 |
| 52.752 | 973.880 | I10 | 3-methylnonane | 0.003 | 0.003 | 0.002 |
| 53.072 | 976.320 | I10 | -[34] | 0.001 | 0.001 | 0.001 |
| 53.262 | 977.760 | -- | unknown | 0.020 | 0.022 | 0.053 |
| 53.701 | 981.070 | A9 | 1,2,4 trimethylbenzene | 0.016 | 0.014 | 0.011 |
| 53.947 | 982.900 | -- | unknown | 0.003 | 0.003 | 0.002 |
| 54.191 | 984.720 | -- | unknown | 0.009 | 0.010 | 0.008 |
| 54.272 | 985.320 | I10 | -[40] | 0.009 | 0.010 | 0.005 |
| 54.466 | 986.920 | I10 | -[42] | 0.002 | 0.003 | 0.001 |
| 54.757 | 988.990 | -- | unknown | 0.006 | 0.007 | 0.015 |
| 55.359 | 993.280 | N10 | -[49] | 0.011 | 0.010 | 0.006 |
| 55.693 | 995.700 | A10 | -[50] | 0.007 | 0.007 | 0.005 |
| 55.754 | 996.130 | -- | unknown | 0.004 | 0.004 | 0.010 |
| 56.131 | 998.840 | P10 | n-decane | 0.009 | 0.009 | 0.005 |

FIG. 11

Detailed Hydrocarbon Analysis Detail Report - Report Date: 10/17/2018 20:44:45

RawFile: \\ww7uspas01acardid7900\Data\2018\OCT\USPAG-18-05158-001-D7900.0000.cdf Acquired: 10/17/18 12:33:35
Sample: USPAG-18-05158-001-D7900 Analyzed: 10/17/2018 20:33:16
Processed 118 Peaks
Reference File: C:\LIEnds in Crude\Results\2018\OCT\531-1800071-001-D7900_10092018.DHA
Comments: Yield: 67.354
Int Std: hexane-1
Int Std Amt: 0.206
Mold Sample Wt: 10.081 Sample Den: 0.793

Components Listed in Chromatographic Order Page: 7

| Minutes | Index | Group | Component | Mass % | Volume % | Mol % |
|---|---|---|---|---|---|---|
| 58.412 | 1001.180 | ... | unknown | 0.006 | 0.006 | 0.015 |

FIG. 12

Alcor Petrolab
Quality testing since 1968
an SGS company

CERTIFICATE OF ANALYSIS

Texas Road Recyclers

Report Date: 10/19/16
Report Number: A1610150015_Preliminary
Sample ID: 2Ul 500g
Sample Type: Residual Fuel Oil

| Test Requested | | Results | Units | Test Method |
|---|---|---|---|---|
| Sulfur | | 17250 | ppm | ASTM D2622 |
| Distillation | | | | ASTM D86 |
| Barometric Pressure | | 752.31 | mm Hg | |
| Initial Boiling Point | | 151.0 | °F | |
| 5% Recovery | | 154.6 | °F | |
| 10% Recovery | | 155.3 | °F | |
| 90% Recovery | | 159.1 | °F | |
| Final Boiling Point | | 170.8 | °F | |
| Total Halogens | | | | ASTM D808M |
| | Bromine | <0.01 | % | |
| | Chlorine | 0.01 | % | |
| | Fluorine | <0.01 | % | |
| Metals by ICP | | | ppm (w/w) | ASTM D5185 |
| | Aluminum | Pending | | |
| | Antimony | Pending | | |
| | Boron | Pending | | |
| | Barium | Pending | | |
| | Cadmium | Pending | | |
| | Calcium | Pending | | |
| | Chromium | Pending | | |
| | Copper | Pending | | |
| | Iron | Pending | | |
| | Lead | Pending | | |
| | Magnesium | Pending | | |
| | Manganese | Pending | | |
| | Molybdenum | Pending | | |
| | Nickel | Pending | | |
| | Phosphorus | Pending | | |
| | Potassium | Pending | | |
| | Silicon | Pending | | |
| | Silver | Pending | | |
| | Sodium | Pending | | |

FIG. 13

Alcor Petrolab
Quality testing since 1968
an SGS company

| Test Requested | Results | Units | Test Method |
|---|---|---|---|
| | | ppm (w/w) | ASTM D5185 |
| Tin | Pending | | |
| Titanium | Pending | | |
| Vanadium | Pending | | |
| Zinc | Pending | | |

Detailed Hydrocarbon Analysis — ASTM D7900

| Group Type | Mass % | Vol% | Mol% |
|---|---|---|---|
| Paraffins | 37.925 | 44.753 | 38.959 |
| i-Paraffins | 10.815 | 12.686 | 10.260 |
| Olefins | 0.083 | 0.093 | 0.079 |
| Napthenes | 18.506 | 19.254 | 18.490 |
| Aromatics | 0.081 | 0.073 | 0.085 |
| Total C14+ | 0.000 | 0.000 | 0.000 |
| Total Unknowns | 0.056 | 0.062 | 0.123 |

FIG. 14

MITCHELL ANALYTICAL LAB
2638 FAUDREE
ODESSA, TEXAS 79765-8538
432.561.5579

SUMMARY OF CHROMATOGRAPHIC ANALYSIS

| | | | |
|---|---|---|---|
| COMPANY: | Delaware Energy | Lab Ref #: | 19-APR-97354 |
| PRODUCER: | D.E. | SAMPLED BY: | S.G. |
| LEASE: | Closed Loop Cutting Extraction | SAMPLE DATE | 2/28/19 |
| STATION #: | n.a. | | |
| DATE RUN: | 4/10/2019 | | |

| COMPONENT | MOLE % | WEIGHT % | VOLUME % | CALCULATED PARAMETERS | |
|---|---|---|---|---|---|
| HYDROGEN SULFIDE | 0.0000 | 0.0000 | 0.0000 | TOTAL ANALYSIS SUMMARY | |
| NITROGEN | 0.0000 | 0.0000 | 0.0000 | | |
| OXYGEN | 0.0000 | 0.0000 | 0.0000 | AVE MOLE WT | 189.6173 |
| METHANE | 0.0000 | 0.0000 | 0.0000 | SP GRAV, 60F/60 | 0.8221 |
| CARBON DIOXIDE | 0.0000 | 0.0000 | 0.0000 | API GRAVITY | 40.8 |
| ETHANE | 0.0000 | 0.0000 | 0.0000 | REL DENS, AIR=1 | 6.5468 |
| PROPANE | 0.0000 | 0.0000 | 0.0000 | VAPOR PRESS PSIA | 0.05 |
| ISO-BUTANE | 0.0042 | 0.0013 | 0.0018 | | |
| N-BUTANE | 0.0117 | 0.0038 | 0.0047 | HEXANES PLUS SUMMARY | |
| ISO-PENTANE | 0.0418 | 0.0159 | 0.0196 | | |
| N-PENTANE (C-5) | 0.0000 | 0.0000 | 0.0000 | AVE MOLE WT | 189.6873 |
| 2,2 DIMETHYL BUTANE | 0.0000 | 0.0000 | 0.0000 | SP GRAV, 60F/60 | 0.8223 |
| CYCLOPENTANE | 0.0000 | 0.0000 | 0.0000 | API GRAVITY | 40.8 |
| 2-METHYLPENTANE | 0.0033 | 0.0015 | 0.0018 | LBS/GAL | 6.579 |
| 3-METHYLPENTANE | 0.0026 | 0.0012 | 0.0014 | REL DENS, AIR=1 | 6.5492 |
| N-HEXANE (C-6) | 0.0035 | 0.0016 | 0.0019 | VAPOR PRESS PSIA | 0.03 |
| METHYLCYCLOPENTANE | 0.0000 | 0.0000 | 0.0000 | | |
| BENZENE | 0.0121 | 0.0050 | 0.0044 | BTEX SUMMARY | |
| CYCLOHEXANE | 0.0045 | 0.0020 | 0.0020 | | |
| 2-METHYLHEXANE | 0.0087 | 0.0046 | 0.0052 | WT % BENZENE | 0.0050 |
| 3-METHYLHEXANE | 0.0026 | 0.0014 | 0.0016 | WT % TOLUENE | 0.0559 |
| DIMETHYLCYCLOPENTA | 0.0048 | 0.0025 | 0.0025 | WT % E BENZENE | 0.2562 |
| HEPTANES | 0.0045 | 0.0024 | 0.0027 | WT % XYLENES | 0.7812 |
| N-HEPTANE (C-7) | 0.0443 | 0.0234 | 0.0261 | | |
| METHYLCYCLOHEXANE | 0.0075 | 0.0038 | 0.0038 | DECANES PLUS SUMMARY | |
| TOLUENE | 0.1150 | 0.0559 | 0.0491 | | |
| OCTANES | 0.1409 | 0.0849 | 0.0923 | AVE MOLE WT | 193.2189 |
| N-OCTANE (C-8) | 0.1024 | 0.0617 | 0.0671 | SP GRAV, 60F/60 | 0.8241 |
| ETHYL BENZENE | 0.4576 | 0.2562 | 0.2252 | API GRAVITY | 40.2 |
| P-M-XYLENE | 0.8708 | 0.4878 | 0.4318 | LBS/GAL | 6.594 |
| O-XYLENE | 0.5244 | 0.2936 | 0.2551 | REL DENS, AIR=1 | 6.6711 |
| NONANES | 0.7630 | 0.5161 | 0.5496 | VAPOR PRESS PSIA | 0.015 |
| N-NONANE (C-9) | 1.5840 | 1.0579 | 1.1286 | | |

CONTINUED ON NEXT PAGE

FIG. 15

Closed Loop Cutting Extraction

| COMPONENT | MOLE % | WEIGHT % | VOLUME % |
|---|---|---|---|
| DECANES | 7.9723 | 5.9820 | 6.2632 |
| N-DECANE (C-10) | 6.6336 | 4.9775 | 5.2115 |
| UNDECANES | 14.0801 | 11.6069 | 11.9841 |
| N-UNDECANE (C-11) | 5.4311 | 4.4771 | 4.6226 |
| DODECANES | 13.4725 | 12.1039 | 12.3588 |
| N-DODECANE (C-12) | 4.9802 | 4.4739 | 4.5685 |
| TRIDECANES | 8.6021 | 8.6553 | 8.7340 |
| N-TRIDECANE (C-13) | 2.0876 | 2.0297 | 2.0482 |
| TETRADECANES | 5.6279 | 5.8883 | 5.9297 |
| N-TETRADECANE (C-14) | 1.0873 | 1.1378 | 1.1456 |
| PENTADECANES | 2.4567 | 2.7521 | 2.7896 |
| N-PENTADECANE (C-15) | 0.5700 | 0.6385 | 0.6356 |
| HEXADECANES | 0.5387 | 0.6433 | 0.6362 |
| N-HEXADECANE (C-16) | 0.2305 | 0.2753 | 0.2723 |
| HEPTADECANES | 0.2323 | 0.2946 | 0.2905 |
| N-HEPTADECANE (C-17) | 0.1584 | 0.2009 | 0.1981 |
| OCTADECANES | 0.3639 | 0.4884 | 0.4801 |
| N-OCTADECANE (C-18) | 0.0833 | 0.0850 | 0.0836 |
| NONADECANES | 0.1822 | 0.2580 | 0.2520 |
| N-NONADECANE (C-19) | 0.0503 | 0.0712 | 0.0695 |
| EICOSANES | 0.1410 | 0.2101 | 0.2041 |
| N-EICOSANES (C-20) | 0.0326 | 0.0486 | 0.0472 |
| HENEICOSANE + (C-21+) | 23.0112 | 29.8188 | 28.3487 |
| TOTALS | 100.0000 | 100.0000 | 100.0000 |

CRUDE OIL FINGERPRINT
C-n/C-13 RATIO SUMMARY

| C-n | C-n/C-13 |
|---|---|
| 10.0 | 2.452 |
| 11.0 | 2.208 |
| 12.0 | 2.304 |
| 13.0 | 1.000 |
| 14.0 | 0.580 |
| 15.0 | 0.315 |
| 16.0 | 0.138 |
| 17.0 | 0.089 |
| 18.0 | 0.042 |
| 19.0 | 0.035 |
| 20.0 | 0.024 |

BIO-MARKER SUMMARY

| | |
|---|---|
| Farnesane/C-14 | 0.198 |
| Pristane/C-17 | 0.717 |
| Phytane/C-18 | 0.652 |
| Weight % Sulfur | n.a. |
| Gravity, API @ 60 F | 40.6 |

FIG. 16

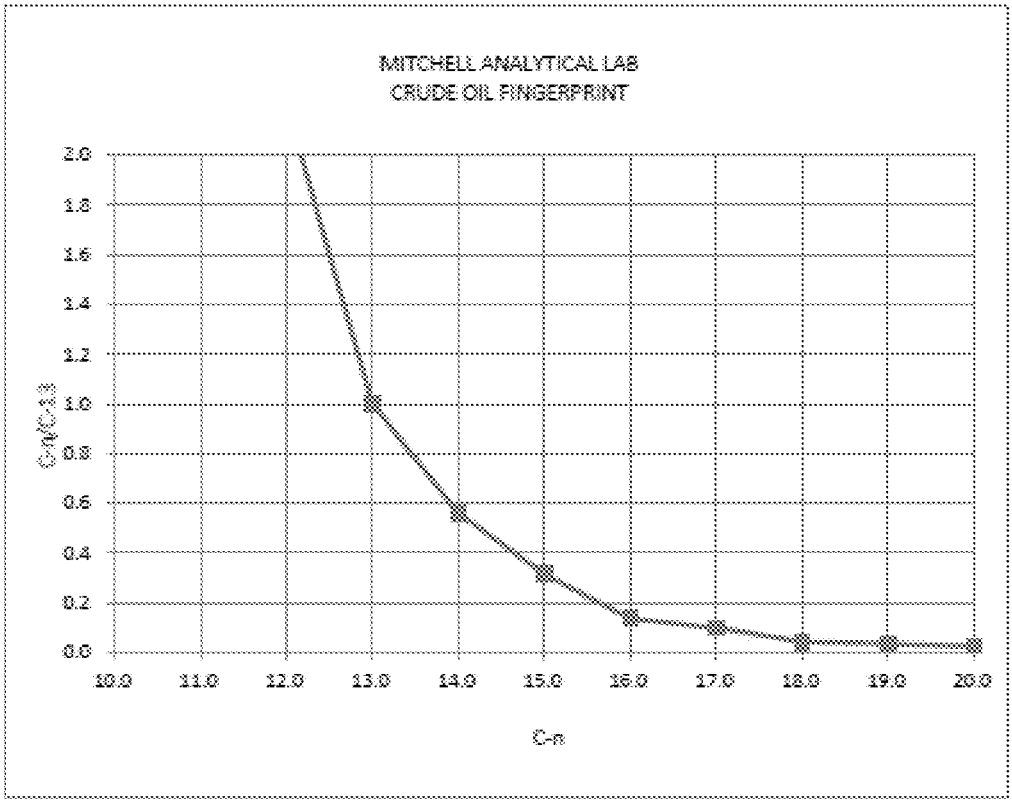
Closed Loop Cutting Extraction
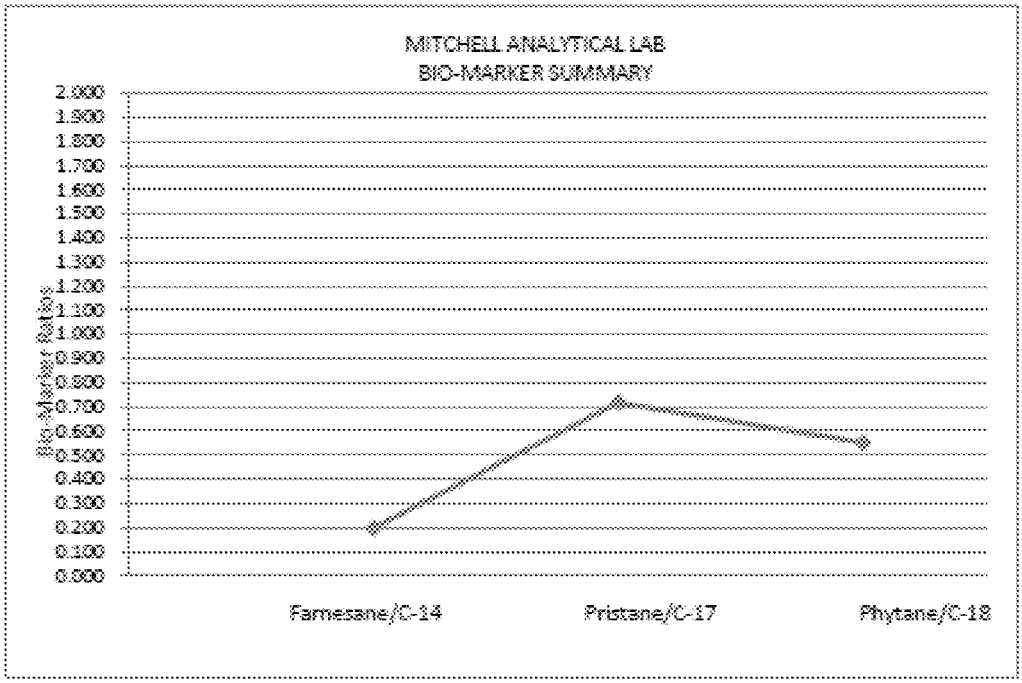
FIG. 17

MITCHELL ANALYTICAL LAB
2638 FAUDREE
ODESSA, TEXAS 79765-8538
432.561.5579

SUMMARY OF CHROMATOGRAPHIC ANALYSIS

| | | | |
|---|---|---|---|
| COMPANY: | Delaware Energy | Lab Ref #: | 19-APR-97355 |
| PRODUCER: | D.E. | SAMPLED BY: | S.G. |
| LEASE: | Wet Cutting Extraction | SAMPLE DATE: | 2/28/19 |
| STATION #: | n.a. | | |
| DATE RUN: | 4/10/2019 | | |

| COMPONENT | MOLE % | WEIGHT % | VOLUME % | CALCULATED PARAMETERS | |
|---|---|---|---|---|---|
| HYDROGEN SULFIDE | 0.0000 | 0.0000 | 0.0000 | TOTAL ANALYSIS SUMMARY | |
| NITROGEN | 0.0000 | 0.0000 | 0.0000 | | |
| OXYGEN | 0.0000 | 0.0000 | 0.0000 | AVE MOLE WT | 185.9313 |
| METHANE | 0.0000 | 0.0000 | 0.0000 | SP GRAV, 60F/60 | 0.8167 |
| CARBON DIOXIDE | 0.0000 | 0.0000 | 0.0000 | API GRAVITY | 41.8 |
| ETHANE | 0.0000 | 0.0000 | 0.0000 | REL DENS, AIR=1 | 6.4195 |
| PROPANE | 0.0000 | 0.0000 | 0.0000 | VAPOR PRESS PSIA | 0.09 |
| ISO-BUTANE | 0.0048 | 0.0015 | 0.0020 | | |
| N-BUTANE | 0.0643 | 0.0201 | 0.0264 | HEXANES PLUS SUMMARY | |
| ISO-PENTANE | 0.0000 | 0.0000 | 0.0000 | | |
| N-PENTANE (C-5) | 0.0049 | 0.0019 | 0.0023 | AVE MOLE WT | 188.0252 |
| 2,2 DIMETHYL BUTANE | 0.0000 | 0.0000 | 0.0000 | SP GRAV, 60F/60 | 0.8188 |
| CYCLOPENTANE | 0.0000 | 0.0000 | 0.0000 | API GRAVITY | 41.7 |
| 2-METHYLPENTANE | 0.0086 | 0.0040 | 0.0047 | LBS/GAL | 6.535 |
| 3-METHYLPENTANE | 0.0078 | 0.0036 | 0.0041 | REL DENS, AIR=1 | 6.4228 |
| N-HEXANE (C-6) | 0.0177 | 0.0082 | 0.0095 | VAPOR PRESS PSIA | 0.05 |
| METHYLCYCLOPENTANE | 0.0108 | 0.0049 | 0.0050 | | |
| BENZENE | 0.0057 | 0.0024 | 0.0021 | BTEX SUMMARY | |
| CYCLOHEXANE | 0.0479 | 0.0217 | 0.0213 | | |
| 2-METHYLHEXANE | 0.0076 | 0.0041 | 0.0046 | WT % BENZENE | 0.0024 |
| 3-METHYLHEXANE | 0.0247 | 0.0133 | 0.0147 | WT % TOLUENE | 0.0972 |
| DIMETHYLCYCLOPENTA | 0.0170 | 0.0090 | 0.0091 | WT % E BENZENE | 0.4367 |
| HEPTANES | 0.0165 | 0.0089 | 0.0099 | WT % XYLENES | 1.4712 |
| N-HEPTANE (C-7) | 0.1045 | 0.0563 | 0.0628 | | |
| METHYLCYCLOHEXANE | 0.2074 | 0.1073 | 0.1064 | DECANES PLUS SUMMARY | |
| TOLUENE | 0.1961 | 0.0972 | 0.0854 | | |
| OCTANES | 0.6945 | 0.4267 | 0.4637 | AVE MOLE WT | 192.9658 |
| N-OCTANE (C-8) | 0.4082 | 0.2508 | 0.2725 | SP GRAV, 60F/60 | 0.8204 |
| ETHYL BENZENE | 0.7648 | 0.4367 | 0.3837 | API GRAVITY | 41.0 |
| P-M-XYLENE | 1.6283 | 0.9298 | 0.8229 | LBS/GAL | 6.564 |
| O-XYLENE | 0.8481 | 0.5414 | 0.4700 | REL DENS, AIR=1 | 6.6624 |
| NONANES | 1.8178 | 1.2538 | 1.3344 | VAPOR PRESS PSIA | 0.018 |
| N-NONANE (C-9) | 2.0515 | 1.4152 | 1.5062 | | |

CONTINUED ON NEXT PAGE

FIG. 18

Wet Cutting Extraction

| COMPONENT | MOLE % | WEIGHT % | VOLUME % |
|---|---|---|---|
| DECANES | 9.0398 | 6.9175 | 7.2382 |
| N-DECANE (C-10) | 6.1677 | 4.7197 | 4.9385 |
| UNDECANES | 13.2841 | 11.1678 | 11.5237 |
| N-UNDECANE (C-11) | 4.6180 | 3.8823 | 4.0080 |
| DODECANES | 12.6567 | 11.5945 | 11.8324 |
| N-DODECANE (C-12) | 2.9286 | 2.6830 | 2.7381 |
| TRIDECANES | 9.5708 | 9.4899 | 9.5703 |
| N-TRIDECANE (C-13) | 1.8481 | 1.8325 | 1.8480 |
| TETRADECANES | 5.3138 | 5.6899 | 5.7062 |
| N-TETRADECANE (C-14) | 1.0345 | 1.0931 | 1.1001 |
| PENTADECANES | 2.5708 | 2.9370 | 2.9218 |
| N-PENTADECANE (C-15) | 0.6441 | 0.7359 | 0.7321 |
| HEXADECANES | 0.9283 | 1.1305 | 1.1174 |
| N-HEXADECANE (C-16) | 0.3636 | 0.4308 | 0.4256 |
| HEPTADECANES | 0.5945 | 0.7689 | 0.7576 |
| N-HEPTADECANE (C-17) | 0.1989 | 0.2572 | 0.2534 |
| OCTADECANES | 0.4143 | 0.5871 | 0.5572 |
| N-OCTADECANE (C-18) | 0.0812 | 0.1111 | 0.1092 |
| NONADECANES | 0.3353 | 0.4849 | 0.4728 |
| N-NONADECANE (C-19) | 0.0708 | 0.1023 | 0.0999 |
| EICOSANES | 0.2265 | 0.3442 | 0.3342 |
| N-EICOSANES (C-20) | 0.0407 | 0.0618 | 0.0600 |
| HENEICOSANE + (C-21+) | 18.0306 | 27.4001 | 28.0336 |
| TOTALS | 100.0000 | 100.0000 | 100.0000 |

CRUDE OIL FINGERPRINT
C-n/C-13 RATIO SUMMARY

| C-n | C-n/C-13 |
|---|---|
| 10.0 | 2.576 |
| 11.0 | 2.119 |
| 12.0 | 1.464 |
| 13.0 | 1.000 |
| 14.0 | 0.597 |
| 15.0 | 0.402 |
| 16.0 | 0.235 |
| 17.0 | 0.140 |
| 18.0 | 0.081 |
| 19.0 | 0.056 |
| 20.0 | 0.034 |

BIO-MARKER SUMMARY

| | |
|---|---|
| Farnesane/C-14 | 0.226 |
| Pristane/C-17 | 0.562 |
| Phytane/C-18 | 0.604 |
| Weight % Sulfur | n.a. |
| Gravity, API @ 60 F | 41.7 |

FIG. 19

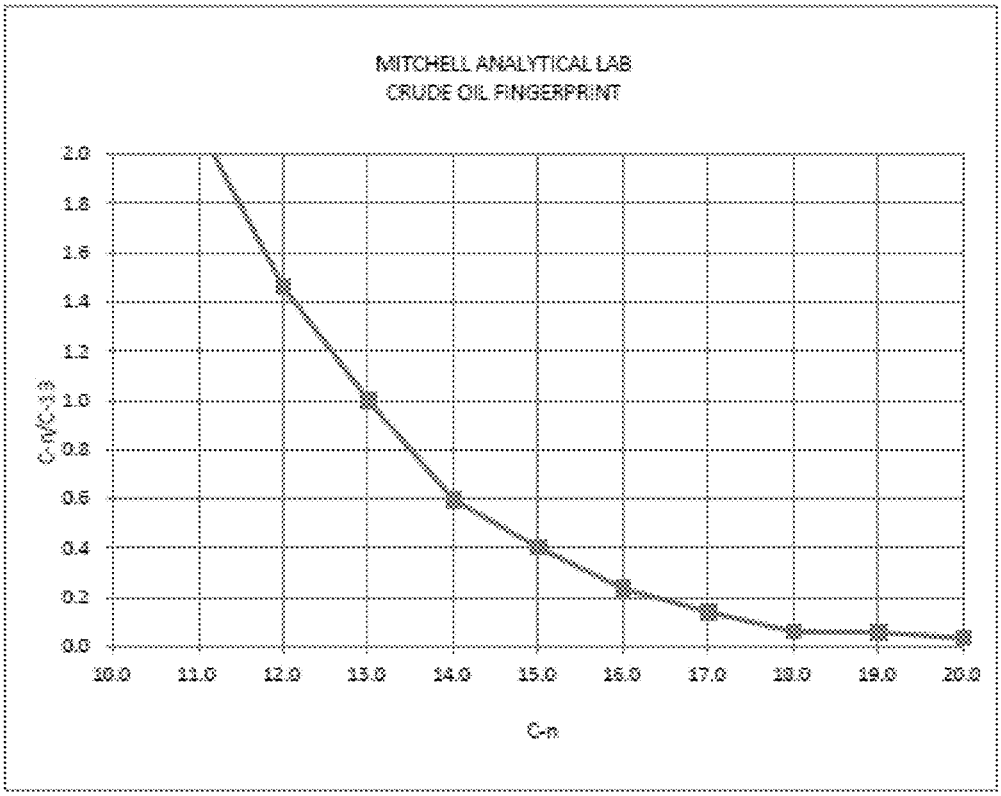
Wet Cutting Extraction
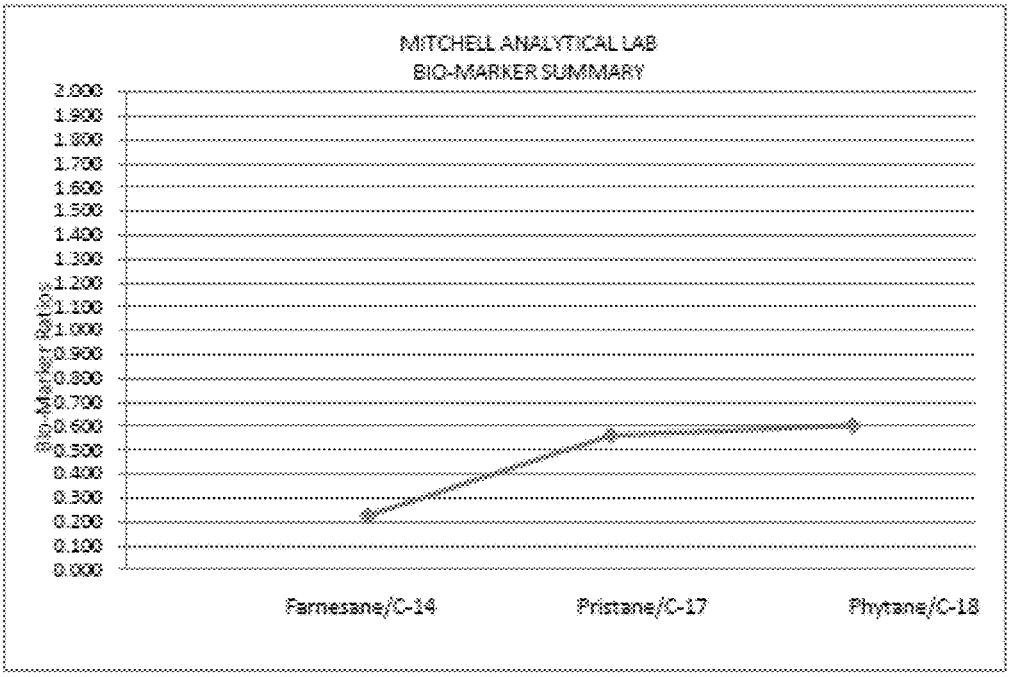
FIG. 20

MITCHELL ANALYTICAL LAB
2638 FAUDREE
ODESSA, TEXAS 79765-8538
432.561.5579

SUMMARY OF CHROMATOGRAPHIC ANALYSIS

| | | | |
|---|---|---|---|
| COMPANY: | Delaware Energy | Lab Ref #: | 19-APR-87353 |
| PRODUCER: | O.E. | SAMPLED BY: | S.G. |
| LEASE: | Left Still Material | SAMPLE DATE | 2/28/19 |
| STATION #: | n.a. | | |
| DATE RUN: | 4/10/2019 | | |

| COMPONENT | MOLE % | WEIGHT % | VOLUME % |
|---|---|---|---|
| HYDROGEN SULFIDE | 0.0000 | 0.0000 | 0.0000 |
| NITROGEN | 0.0000 | 0.0000 | 0.0000 |
| OXYGEN | 0.0000 | 0.0000 | 0.0000 |
| METHANE | 0.0000 | 0.0000 | 0.0000 |
| CARBON DIOXIDE | 0.0000 | 0.0000 | 0.0000 |
| ETHANE | 0.0000 | 0.0000 | 0.0000 |
| PROPANE | 0.0000 | 0.0000 | 0.0000 |
| ISO-BUTANE | 0.0000 | 0.0000 | 0.0000 |
| N-BUTANE | 0.0000 | 0.0000 | 0.0000 |
| ISO-PENTANE | 0.1113 | 0.0361 | 0.0451 |
| N-PENTANE (C-5) | 0.0000 | 0.0000 | 0.0000 |
| 2,2 DIMETHYL BUTANE | 0.0000 | 0.0000 | 0.0000 |
| CYCLOPENTANE | 0.0000 | 0.0000 | 0.0000 |
| 2-METHYLPENTANE | 0.0000 | 0.0000 | 0.0000 |
| 3-METHYLPENTANE | 0.0000 | 0.0000 | 0.0000 |
| N-HEXANE (C-6) | 0.0000 | 0.0000 | 0.0000 |
| METHYLCYCLOPENTANE | 0.0000 | 0.0000 | 0.0000 |
| BENZENE | 0.0000 | 0.0000 | 0.0000 |
| CYCLOHEXANE | 0.0000 | 0.0000 | 0.0000 |
| 2-METHYLHEXANE | 0.0000 | 0.0000 | 0.0000 |
| 3-METHYLHEXANE | 0.0000 | 0.0000 | 0.0000 |
| DIMETHYLCYCLOPENTA | 0.0000 | 0.0000 | 0.0000 |
| HEPTANES | 0.0000 | 0.0000 | 0.0000 |
| N-HEPTANE (C-7) | 0.0517 | 0.0233 | 0.0264 |
| METHYLCYCLOHEXANE | 0.0000 | 0.0000 | 0.0000 |
| TOLUENE | 0.0036 | 0.0015 | 0.0013 |
| OCTANES | 0.0154 | 0.0079 | 0.0087 |
| N-OCTANE (C-8) | 0.0056 | 0.0029 | 0.0032 |
| ETHYL BENZENE | 0.0155 | 0.0074 | 0.0066 |
| P-M-XYLENE | 0.0291 | 0.0139 | 0.0125 |
| O-XYLENE | 0.0247 | 0.0118 | 0.0104 |
| NONANES | 0.0395 | 0.0222 | 0.0240 |
| N-NONANE (C-9) | 0.0496 | 0.0288 | 0.0309 |

CALCULATED PARAMETERS

| TOTAL ANALYSIS SUMMARY | |
|---|---|
| AVE MOLE WT | 222.5083 |
| SP GRAV, 60F/60 | 0.8448 |
| API GRAVITY | 36.0 |
| REL DENS, AIR=1 | 7.6824 |
| VAPOR PRESS PSIA | 0.03 |

| HEXANES PLUS SUMMARY | |
|---|---|
| AVE MOLE WT | 222.6759 |
| SP GRAV, 60F/60 | 0.8450 |
| API GRAVITY | 36.0 |
| LBS/GAL | 6.761 |
| REL DENS, AIR=1 | 7.6882 |
| VAPOR PRESS PSIA | 0.00 |

| BTEX SUMMARY | |
|---|---|
| WT % BENZENE | 0.0000 |
| WT % TOLUENE | 0.0015 |
| WT % E.BENZENE | 0.0074 |
| WT % XYLENES | 0.0257 |

| DECANES PLUS SUMMARY | |
|---|---|
| AVE MOLE WT | 222.9314 |
| SP GRAV, 60F/60 | 0.8452 |
| API GRAVITY | 35.9 |
| LBS/GAL | 6.763 |
| REL DENS, AIR=1 | 7.6970 |
| VAPOR PRESS PSIA | 0.003 |

CONTINUED ON NEXT PAGE

FIG. 21

Left Still Material

| COMPONENT | MOLE % | WEIGHT % | VOLUME % |
|---|---|---|---|
| DECANES | 0.6079 | 0.3867 | 0.4128 |
| N-DECANE (C-10) | 0.7569 | 0.4840 | 0.5140 |
| UNDECANES | 2.9150 | 1.9775 | 2.0711 |
| N-UNDECANE (C-11) | 1.8477 | 1.2980 | 1.3595 |
| DODECANES | 8.3538 | 5.2469 | 5.4349 |
| N-DODECANE (C-12) | 2.7827 | 2.1303 | 2.2066 |
| TRIDECANES | 10.9938 | 9.1007 | 9.3155 |
| N-TRIDECANE (C-13) | 3.4400 | 2.8502 | 2.9175 |
| TETRADECANES | 10.0715 | 8.9798 | 9.1729 |
| N-TETRADECANE (C-14) | 3.3248 | 2.9644 | 3.0282 |
| PENTADECANES | 7.7801 | 7.4274 | 7.4999 |
| N-PENTADECANE (C-15) | 3.2507 | 3.1033 | 3.1336 |
| HEXADECANES | 3.9352 | 4.0047 | 4.0178 |
| N-HEXADECANE (C-16) | 2.4514 | 2.4947 | 2.5027 |
| HEPTADECANES | 3.4315 | 3.7085 | 3.7090 |
| N-HEPTADECANE (C-17) | 2.1028 | 2.2725 | 2.2728 |
| OCTADECANES | 2.9135 | 3.3334 | 3.3231 |
| N-OCTADECANE (C-18) | 1.6027 | 1.8331 | 1.8280 |
| NONADECANES | 1.8556 | 2.2394 | 2.2189 |
| N-NONADECANE (C-19) | 1.3334 | 1.6092 | 1.5945 |
| EICOSANES | 0.9981 | 1.2674 | 1.2489 |
| N-EICOSANES (C-20) | 0.9993 | 1.2563 | 1.2380 |
| HENEICOSANE + (C-21+) | 23.5266 | 29.8750 | 28.8109 |
| TOTALS | 100.0000 | 100.0000 | 100.0000 |

CRUDE OIL FINGERPRINT
C-n/C-13 RATIO SUMMARY

| C-n | C-n/C-13 |
|---|---|
| 10.0 | 0.170 |
| 11.0 | 0.455 |
| 12.0 | 0.747 |
| 13.0 | 1.000 |
| 14.0 | 1.040 |
| 15.0 | 1.089 |
| 16.0 | 0.875 |
| 17.0 | 0.797 |
| 18.0 | 0.643 |
| 19.0 | 0.585 |
| 20.0 | 0.441 |

BIO-MARKER SUMMARY

| | |
|---|---|
| Famesane/C-14 | 0.154 |
| Pristane/C-17 | 0.422 |
| Phytane/C-18 | 0.404 |
| Weight % Sulfur | n.a. |
| Gravity, API @ 60 F | 36.0 |

FIG. 22

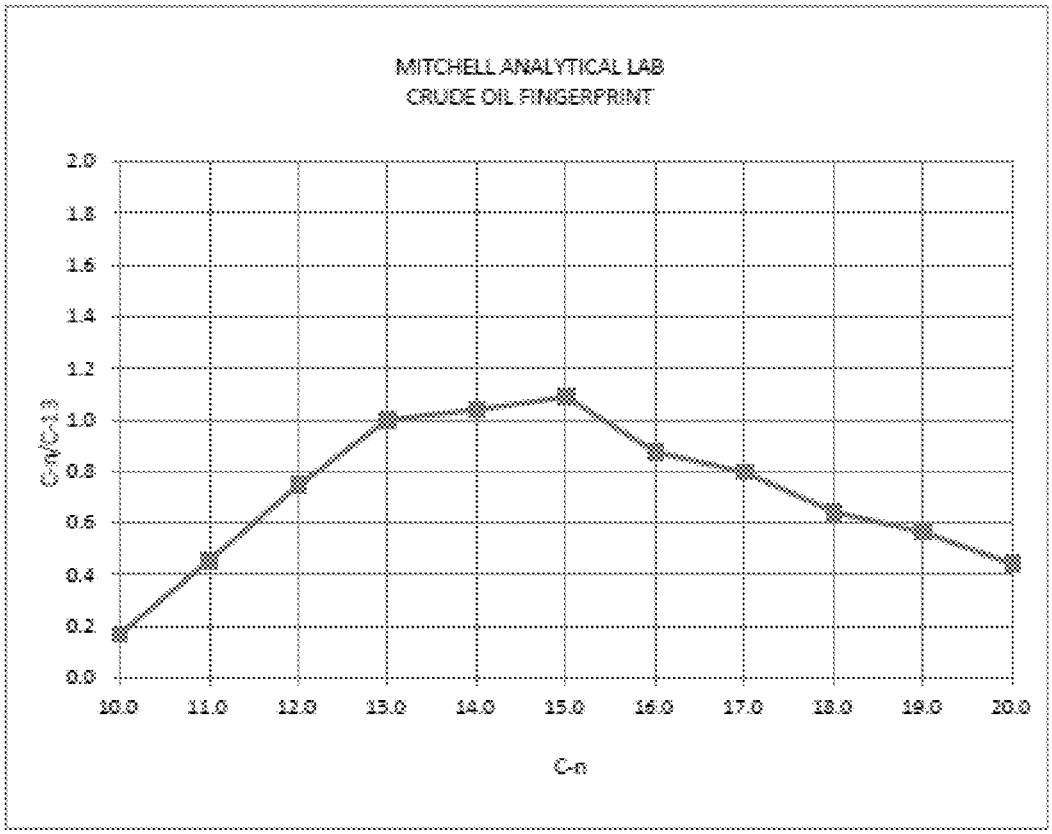
Left Still Material
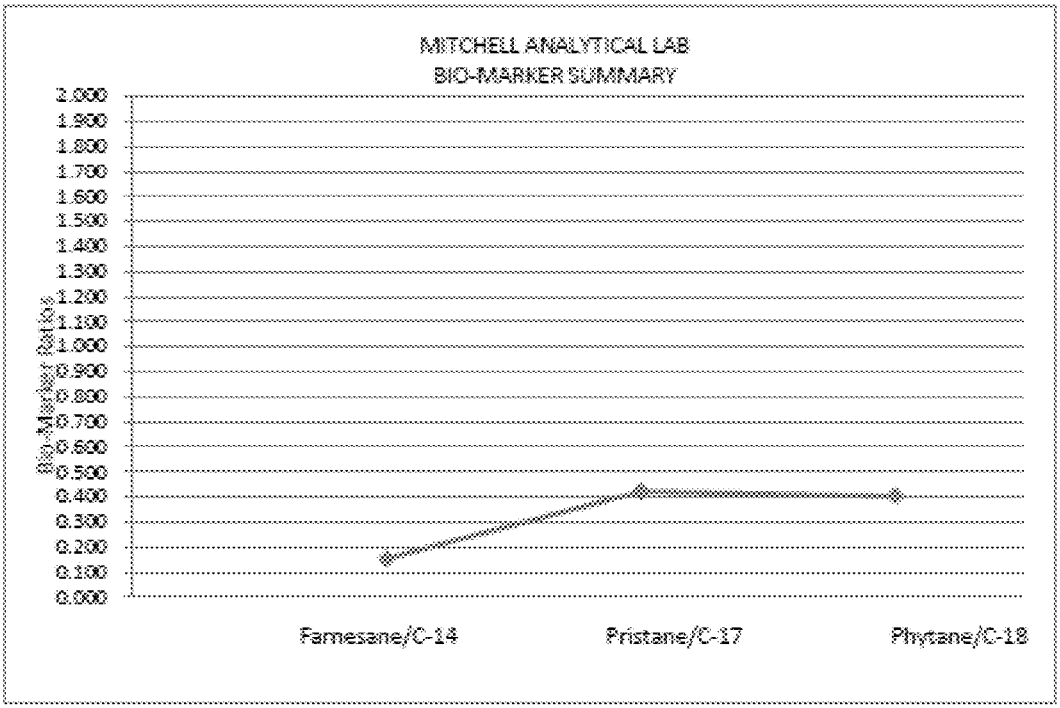
FIG. 23

PROCESS FOR EXTRACTING LIGHT HYDROCARBONS FROM AGGREGATE MATERIAL

CROSS-REFERENCE TO RELATED APPLICATIONS

This application is related to and claims the benefit of U.S. Provisional Application Nos. 62/782,682, filed on Dec. 20, 2018, and 62/840,016, filed on Apr. 29, 2019, the entire contents of each being incorporated herein by reference.

FIELD OF THE INVENTION

Embodiments can relate to processes for extracting light hydrocarbons from a by-product of aggregate material.

BACKGROUND OF THE INVENTION

Methods for making aggregate material (e.g., aggregate for roadway material) can involve processing Limestone Rock Asphalt ("LRA"). LRA is a naturally occurring limestone material that is formed when a limestone deposit is naturally impregnated with hydrocarbons (likely a crude oil deposit that flowed up through the rock deposit). LRA has been mined for many years, and processed into products used for roadway construction and maintenance. During the processing of aggregate material, a waste material is produced known as crusher fines. Crusher fines are a common waste product of any rock crushing operation. In the case of LRA, the waste material is known as LRA crusher fines.

LRA fines, just like the LRA rock from which they are derived, are naturally impregnated with hydrocarbons. Conventional methods can be used to extract these hydrocarbons. Yet, conventional methods are limited in that they cannot successfully extract light hydrocarbon fractions (e.g., fractions with a molecular weight of less than C14) in a manner that is economically and commercially sustainable.

SUMMARY OF THE INVENTION

Embodiments of the inventive method can involve subjecting material to an extraction process to extract light hydrocarbon fractions (e.g., hydrocarbon fractions having molecular weights from C1 to C14) from the material to generate a resultant extraction material comprising mostly if not entirely of light hydrocarbon fractions. In some embodiments, the extraction process can involve performing the extraction in iterations to prevent or reduce the amount of heavy hydrocarbon fractions (e.g., hydrocarbon fractions having molecular weights greater than C14—e.g., C15 to C60)) from being extracted.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

The above and other objects, aspects, features, advantages and possible applications of the present innovation will be more apparent from the following more particular description thereof, presented in conjunction with the following drawings. Like reference numbers used in the drawings may identify like components.

FIGS. 6-14 are laboratory test results of resultant extracted material that has been generated using an embodiment of the extraction process.

FIGS. 15-17 are laboratory test results of resultant extracted material, showing chromatographic analyses, crude oil fingerprint, and bio-marker summary information for drill cuttings obtained from closed loop extraction drilling methods (closed loop extraction generates dryer material)

FIGS. 18-20 are laboratory test results of resultant extracted material, showing chromatographic analyses, crude oil fingerprint, and bio-marker summary information for drill cuttings obtained from wet cutting extraction drilling methods (wet cutting extraction generates wetter material).

FIGS. 21-23 are laboratory test results of resultant extracted material, showing chromatographic analyses, crude oil fingerprint, and bio-marker summary information for left still material.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of the present invention. The scope of the present invention is not limited by this description.

One of the reasons conventional methods for extracting hydrocarbons from material are limited is that the processes involved extract the heavier hydrocarbons (e.g., hydrocarbons having molecular weights greater than C14) during the extraction process, leading to a resultant extraction material that is essentially hard asphalt. Embodiment of the inventive process, however, can involve extraction of hydrocarbons from base material so that only (or at least a majority) of the hydrocarbons extracted comprise molecular weights less than C14. Having a resultant extraction material that comprises entirely or mostly of hydrocarbons having molecular weights that are less than C14 can be desirable for many applications.

Figure 1:
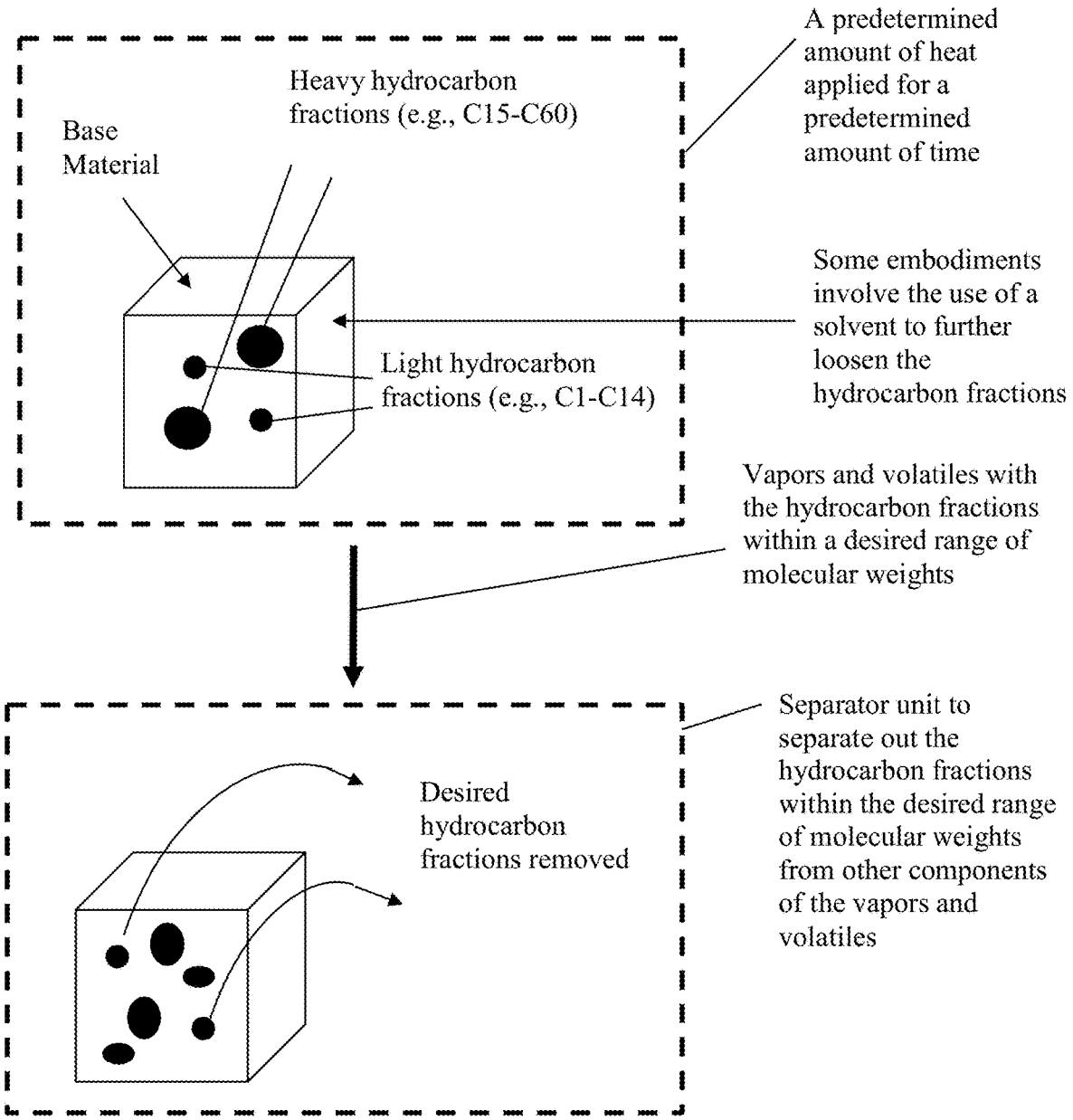
FIG. 1 is an exemplary illustration of an embodiment of the extraction process.
Figure 2:
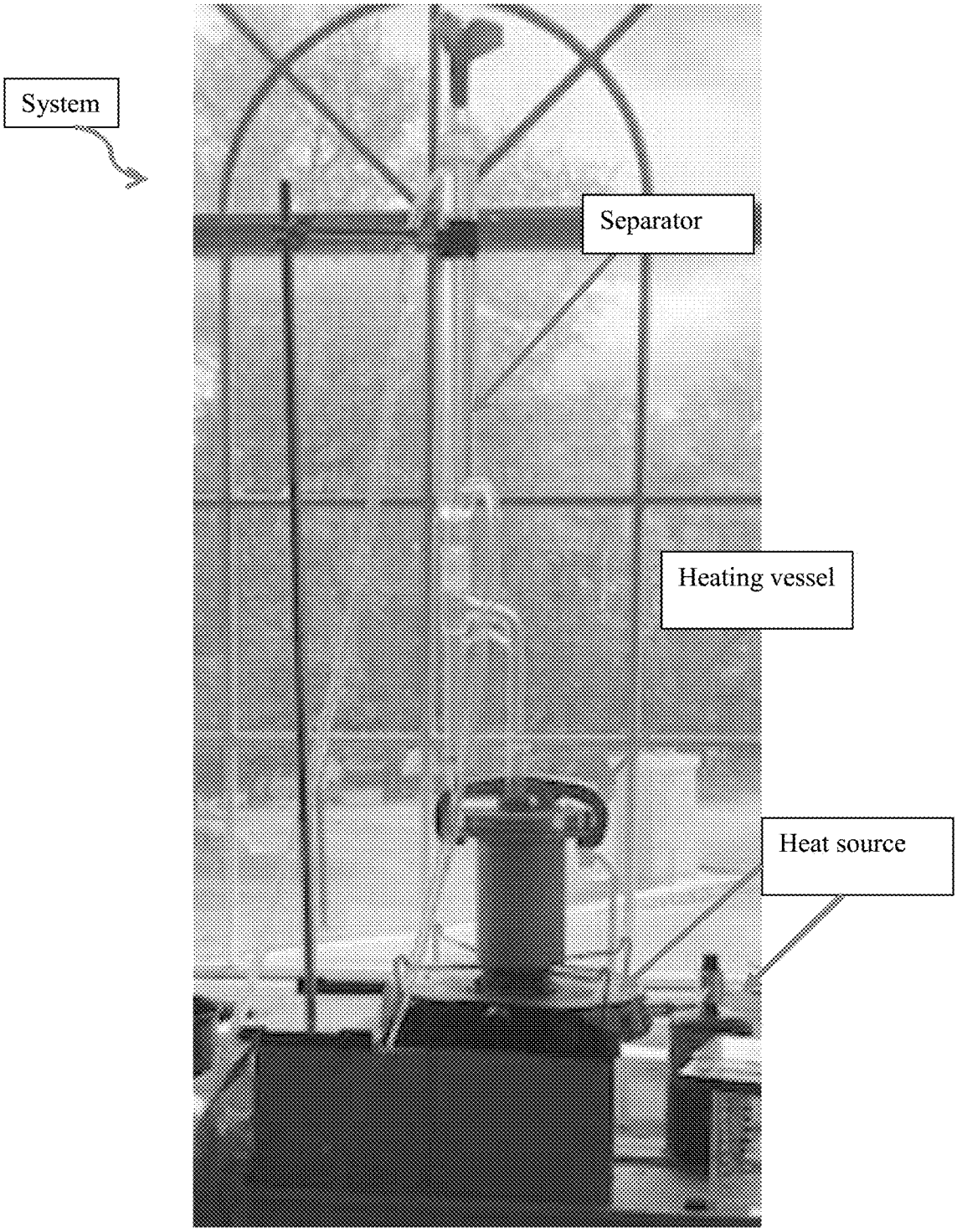
FIG. 2 is an exemplary system configuration that can be used to carry out an embodiment of the extraction process.
Figure 3:
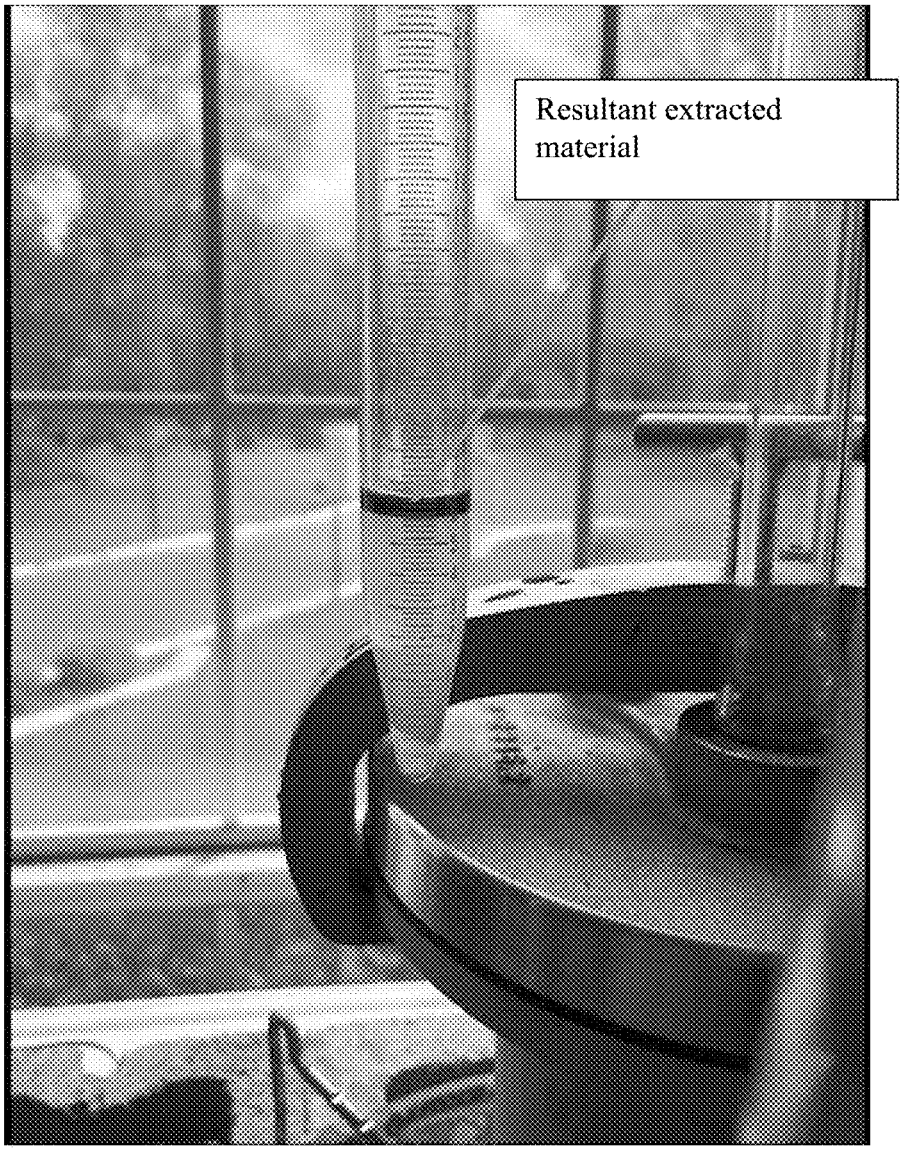
FIGS. 3-4 are images of resultant extracted material being extracted by an embodiment of the extraction process.
Figure 4:
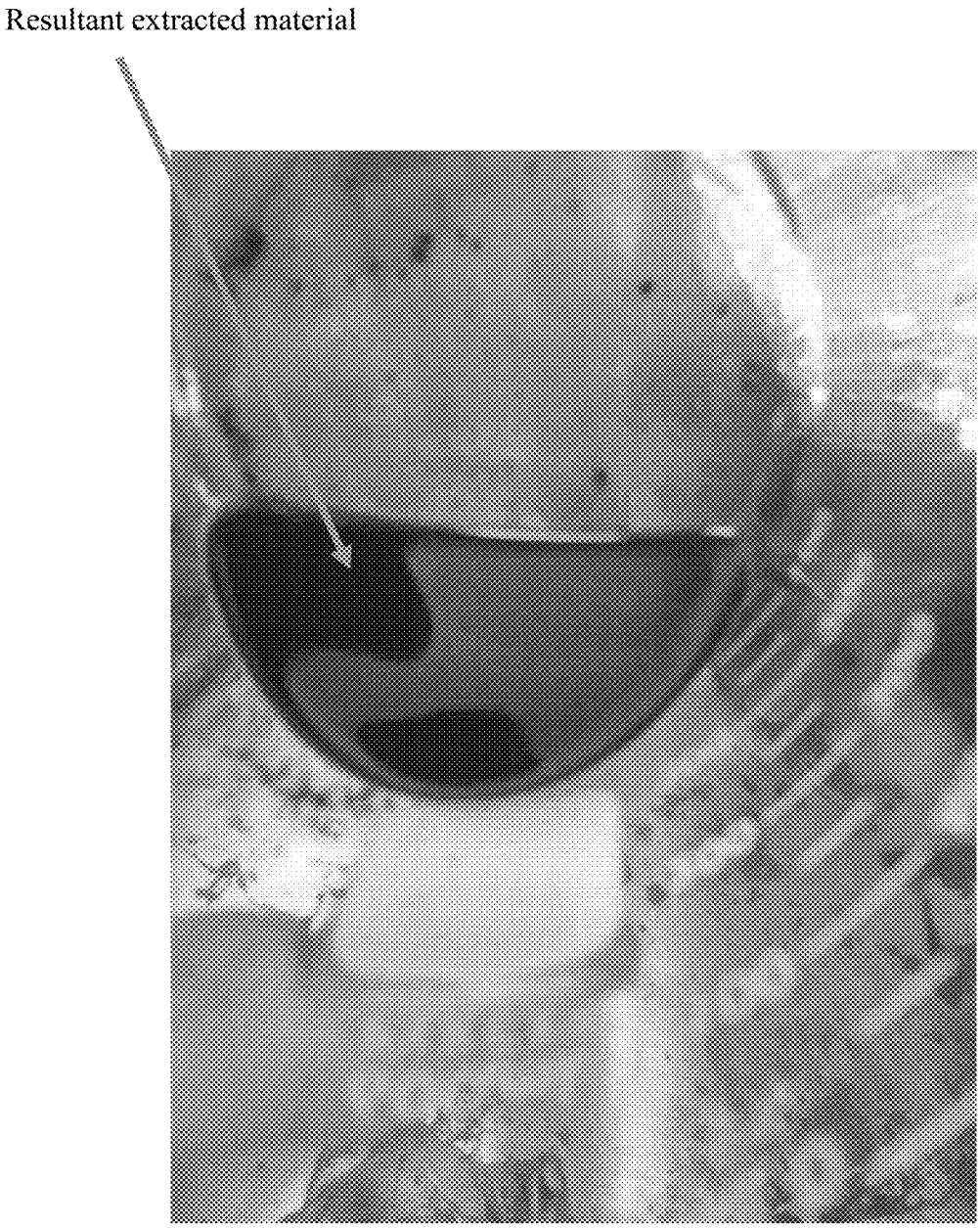
Figure 5:
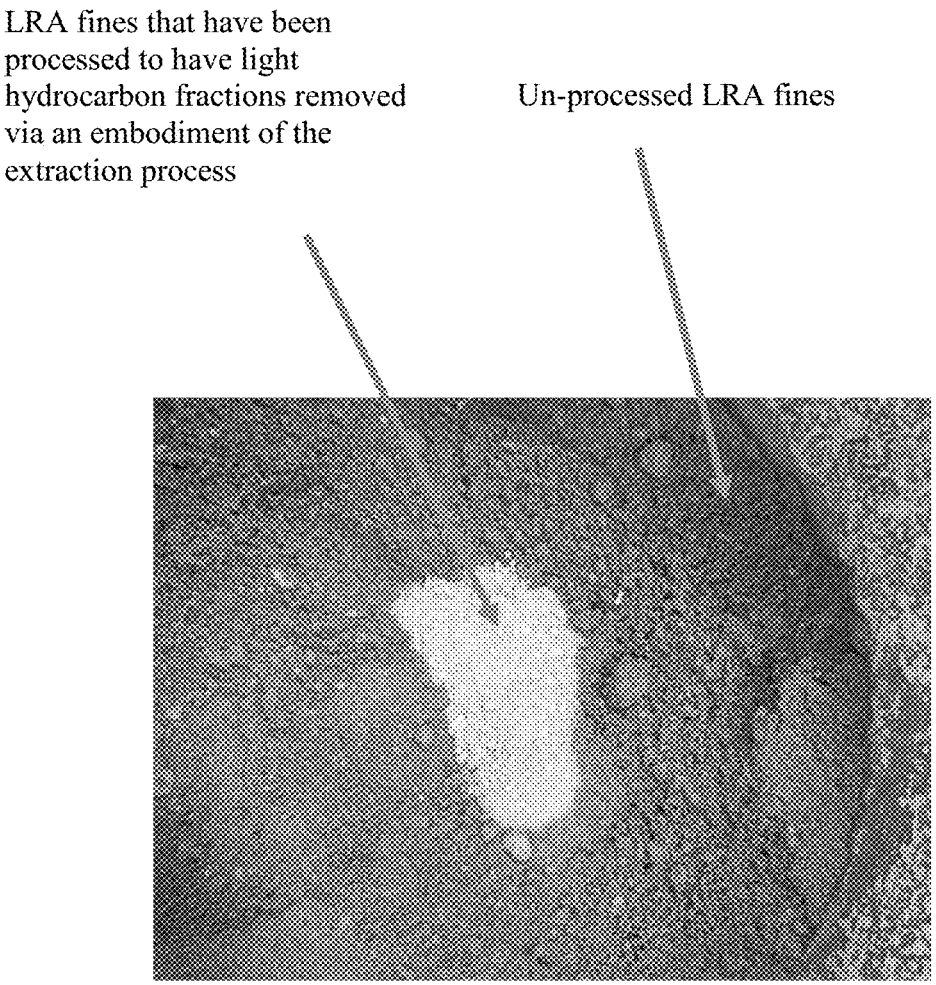
FIG. 5 is an image of LRA crusher fines that have had the light hydrocarbon fractions extracted. The lighter colored material is the LRA crusher fines after the light hydrocarbon fractions had been removed by an embodiment of the extraction process. The darker colored material is unprocessed LRA crusher fines.

Referring to FIGS. 1-5, embodiments of the inventive method can involve subjecting base material to an extraction process. The base material can be material that has hydrocarbons impregnated within it. As a non-limiting example, the base material can be crusher fines (e.g., by-product of making aggregate material used for roadways), which can include LRA crusher fines. Other base materials that have hydrocarbons impregnated within it can be used. These can include shingle material, reclaimed asphalt material ("RAP"), drill cuttings, etc. Some base materials can include a combination of LRA crusher fines, shingle material, RAP, drill cuttings, etc.

Embodiments of the extraction process can involve freeing or loosening hydrocarbon fractions from the matrix of the base material. One technique for free or loosening the hydrocarbon fractions form the matrix of the base material can involve use of a solvent, which when applied, can form a hydrocarbon rich solvent solution that is free from the matrix of the base material. In addition, or in the alternative, the base material and/or the hydrocarbon rich solvent solution can be subjected to a heating treatment to free or loosen hydrocarbon fractions from the matrix of the base material. It should be noted that: some embodiments involve the use of the solvent only; some embodiments involve the use of a heating treatment only; and some embodiments involve the use of the solvent and the heating treatment in combination. When used in combination, the solvent can be used before, during, and/or after the heating treatment.

The base material and/or the hydrocarbon rich solvent solution can then be subjected to a separator to separate and withdraw the desired hydrocarbon fractions of certain molecular weights from the solution and/or base material, thereby forming the resultant extraction material. This can involve use of condensation columns, centrifuges, separators, etc. Other mechanical, electrical, and/or chemical systems, in addition to or in lieu of the separator, can be used to facilitate withdrawal of the desired hydrocarbon fractions from the base material and/or the hydrocarbon rich solvent solution.

Hydrocarbon fractions having molecular weights from C1 to C14 can be referred to herein as light hydrocarbon fractions. Hydrocarbon fractions having molecular weights greater than C14 can be referred to herein as heavy hydrocarbon fractions. While the extraction process can be used to extract hydrocarbon fractions from the base material having molecular weights from C1 to C14 (or any other range there-between), the extraction process can be used to extract hydrocarbon fractions from the base material having molecular weights from from C1 to C60 (or any range there-between). It is contemplated to utilize the method to more aggressively extract the light weight hydrocarbons (e.g., C1 to C14) because doing so would be most beneficial from an economic standpoint. Other factors may be used that would cause one to utilize the method to more aggressively extract other molecular weight ranges of hydrocarbons. It should be noted that conventional systems and methods are not configured to limit the extraction to a specific molecular weight range, but rather attempt to extract all of the hydrocarbon fractions. This is one of the drawbacks of conventional systems, leading to inefficiencies and increased costs.

For instance, with embodiments that are designed to more aggressively extract hydrocarbon fractions from the base material having molecular weights from C1 to C14, the extraction process can be configured to generate a resultant extraction material having hydrocarbon fractions with molecular weights comprising any one or combination of: C1; C1 and/or C2; C1, C2, and/or C3; C1, C2, C3, and/or C4; C1, C2, C3, C4, and/or C5; C1, C2, C3, C4, C5 and/or C6; C1, C2, C3, C4, C5, C6, and/or C7; C1, C2, C3, C4, C5, C6, C7, and/or C8; C1, C2, C3, C4, C5, C6, C7, C8, and/or C9; C1, C2, C3, C4, C5, C6, C7, C8, C9, and/or C10; C1, C2, C3, C4, C5, C6, C7, C8, C9, C10, and/or C11; C1, C2, C3, C4, C5, C6, C7, C8, C9, C10, C11, and/or C12; C1, C2, C3, C4, C5, C6, C7, C8, C9, C10, C11, C12, and/or C13; and/or C1, C2, C3, C4, C5, C6, C7, C8, C9, C10, C11, C12, C13, and/or C14. As another example, with embodiments that are designed to more aggressively extract hydrocarbon fractions from the base material having molecular weights from C5 to C10, the extraction process can be configured to generate a resultant extraction material having hydrocarbon fractions with molecular weights comprising any one or combination of: C5; C5 and/or C6; C5, C6, and/or C7; C5, C6, C7, and/or C8; C5, C6, C7, C8, and/or C9; C5, C6, C7, C8, C9 and/or C10. As another example, with embodiments that are designed to more aggressively extract hydrocarbon fractions from the base material having molecular weights from C25 to C30, the extraction process can be configured to generate a resultant extraction material having hydrocarbon fractions with molecular weights comprising any one or combination of: C25; C25 and/or C26; C25, C26, and/or C27; C25, C26, C27, and/or C28; C25, C26, C27, C28, and/or C29; C25, C26, C27, C28, C29 and/or C30. Similar molecular weight combinations and permutations can be used for other ranges (other than the exemplary ranges of C1 to C14, C5 to C10, and C25 to C 30 described above) of extraction.

The extraction process can involve performing the extraction in iterations. This can involve iteratively extracting hydrocarbon fractions from the material in stages. For example, a first heating treatment and/or a first solvent can be used to grossly extract light hydrocarbon fractions (e.g., C1-C14), then a second heating treatment and/or a second solvent can be used to more finely extract additional light hydrocarbon fractions, then a third heating treatment and/or a third solvent can be used to even more finely extract additional light hydrocarbon fractions, etc. As another example, a first heating treatment and/or a first solvent can be used to extract a first set of light hydrocarbon fractions (e.g., C1-C3), then a second heating treatment and/or a second solvent can be used to extract a second set of light hydrocarbon fractions (e.g., C4-C9), then a third heating treatment and/or a third solvent can be used to extract a third set of light hydrocarbon fractions (e.g., C10-C14). This iterative process can be done to prevent or reduce the amount of heavy hydrocarbon fractions from being extracted.

While embodiment of the extraction process can involve extracting heavy hydrocarbon fractions, it is contemplated for the extraction process to only extract light hydrocarbon fractions to generate the resultant extraction material, or at least extract light hydrocarbon fractions so that the resultant extraction material comprises of a majority of light hydrocarbon fractions. As noted above, this is generally done to render the method more economically feasible. Thus, embodiments disclosed herein will generally discuss extraction processes in which the resultant material consists of or consists essentially of C1 to C14 hydrocarbon fractions. However, one skilled in the art, with the benefit of the present disclosure, will appreciated that the methods disclosed herein can be used to generate resultant material consisting of or essentially consisting of a range of C1 to C60 hydrocarbon fractions. Again, conventional systems and methods cannot generate a resultant extracted material consisting of or consisting essentially of hydrocarbon factions with a desired range of molecular weights. Instead, conventional systems and methods attempt to extract all of the hydrocarbon fractions that are within the base material.

Embodiments of the extraction process can involve subjecting the base material to the extraction process so that the resultant extraction material comprises any one of: 100% light hydrocarbon fractions to 0% heavy hydrocarbon fractions; 95% light hydrocarbon fractions to 5% heavy hydrocarbon fractions; 90% light hydrocarbon fractions to 10% heavy hydrocarbon fractions; 85% light hydrocarbon fractions to 15% heavy hydrocarbon fractions; 80% light hydrocarbon fractions to 20% heavy hydrocarbon fractions; 75% light hydrocarbon fractions to 25% heavy hydrocarbon fractions; 70% light hydrocarbon fractions to 30% heavy hydrocarbon fractions; 65% light hydrocarbon fractions to 35% heavy hydrocarbon fractions; 60% light hydrocarbon fractions to 40% heavy hydrocarbon fractions; 65% light hydrocarbon fractions to 45% heavy hydrocarbon fractions; 50% light hydrocarbon fractions to 50% heavy hydrocarbon fractions; 45% light hydrocarbon fractions to 55% heavy hydrocarbon fractions; 40% light hydrocarbon fractions to 60% heavy hydrocarbon fractions; 35% light hydrocarbon fractions to 65% heavy hydrocarbon fractions; 30% light hydrocarbon fractions to 70% heavy hydrocarbon fractions; 25% light hydrocarbon fractions to 75% heavy hydrocarbon fractions; 20% light hydrocarbon fractions to 80% heavy hydrocarbon fractions; 15% light hydrocarbon fractions to 85% heavy hydrocarbon fractions; 10% light hydrocarbon fractions to 90% heavy hydrocarbon fractions; 5% light hydrocarbon fractions to 95% heavy hydrocarbon fractions; 0% light hydrocarbon fractions to 100% heavy hydrocarbon fractions; or any range within the ranges identified above.

For instance, assume the base material has hydrocarbon fractions with molecular weights from C1 to C60, and a user wants to utilize the method to more aggressively extract hydrocarbon fractions from the base material so that the resultant extracted material consists of or consists essentially of hydrocarbon fraction with molecular weights from C1 to C14, thereby leaving the C15 to C60 hydrocarbon fractions behind (leave them in the base material). The extraction process can be configured to generate a resultant extraction material having hydrocarbon fractions with molecular weights comprising any one or combination of: C1; C1 and/or C2; C1, C2, and/or C3; C1, C2, C3, and/or C4; C1, C2, C3, C4, and/or C5; C1, C2, C3, C4, C5 and/or C6; C1, C2, C3, C4, C5, C6, and/or C7; C1, C2, C3, C4, C5, C6, C7, and/or C8; C1, C2, C3, C4, C5, C6, C7, C8, and/or C9; C1, C2, C3, C4, C5, C6, C7, C8, C9, and/or C10; C1, C2, C3, C4, C5, C6, C7, C8, C9, C10, and/or C11; C1, C2, C3, C4, C5, C6, C7, C8, C9, C10, C11, and/or C12; C1, C2, C3, C4, C5, C6, C7, C8, C9, C10, C11, C12, and/or C13; and/or C1, C2, C3, C4, C5, C6, C7, C8, C9, C10, C11, C12, C13, and/or C14. Yet, conventional systems and methods would only be able to extract (or attempt to extract) all of the C1 to C60 hydrocarbon fractions, and not be able to discriminate the extraction to a desired range of molecular weights.

As another example, assume the base material has hydrocarbon fractions with molecular weights from C1 to C40, and a user wants to utilize the method to more aggressively extract hydrocarbon fractions from the base material so that the resultant extracted material consists of or consists essentially of hydrocarbon fraction with molecular weights from C5 to C10, thereby leaving the C1 to C4 and C11 to C40 hydrocarbon fractions behind (leave them in the base material). The extraction process can be configured to generate a resultant extraction material having hydrocarbon fractions with molecular weights comprising any one or combination of: C5; C5 and/or C6; C5, C6, and/or C7; C5, C6, C7, and/or C8; C5, C6, C7, C8, and/or C9; C5, C6, C7, C8, C9 and/or C10.

As another example, assume the base material has hydrocarbon fractions with molecular weights from C10 to C50, and a user wants to utilize the method to more aggressively extract hydrocarbon fractions from the base material so that the resultant extracted material consists of or consists essentially of hydrocarbon fraction with molecular weights from C25 to C30, thereby leaving the C10 to C24 and C31 to C50 hydrocarbon fractions behind (leave them in the base material). The extraction process can be configured to generate a resultant extraction material having hydrocarbon fractions with molecular weights comprising any one or combination of: C25; C25 and/or C26; C25, C26, and/or C27; C25, C26, C27, and/or C28; C25, C26, C27, C28, and/or C29; C25, C26, C27, C28, C29 and/or C30.

An exemplary system that can be used to carry out an embodiment of the extraction process can include a heating vessel, a heat source, and a separator. The heating vessel can be a kiln, ladle, crucible, etc. The heat source can be a furnace (e.g., combustion furnace, electric furnace, induction furnace, etc.), heater, heat pump, etc. The separator can be a condenser, columnar condenser, separator, distiller, etc. Some embodiments can further include fluid displacement mechanism to force or assist the movement of the base material, hydrocarbon rich solvent solution, or resultant extraction material throughout the system. This can include a pump, a paddle, a propeller, etc.

For instance, the system can include a heating vessel configured to contain base material and/or solvent that will be heated. The heating vessel can be connected to, positioned proximate to, or placed within the heating source. The heating vessel can be connected to the separator so that vapors and volatiles driven off by the heating process are directed from the heating vessel to the separator. The vapors and volatiles contain the hydrocarbon fractions within the desired range of molecular weights to be extracted (e.g., the C1 to C14, the C5 to C15, etc.). Adjustment of the heating treatment and/or the solvent used can be done to adjust the molecular weights of hydrocarbon fractions that will be in the vapors and volatiles. The separator can be configured to separate out the desired hydrocarbon fractions from other components. At least one fluid displacement mechanism can be connected to a portion of the system to force or assist the movement of base material, hydrocarbon rich solvent solution, and/or resultant extraction material.

In a non-limiting, exemplary operation of the system, base material can be placed inside the heating vessel. The heating vessel can be placed on, at, near, or within the heating source so that heat is transferred to the base material. The heating vessel and/or separator can be configured to prevent any vapors and volatiles being driven off from the base material to flow from the heating vessel until permitted to do so. This can be achieved via the use of valves, for example. Thus, the system can operate under heating campaigns. A heating campaign can be subjecting the base material (and solvent if a solvent is used) to a heating treatment. The heating treatment can include subjecting the base material and/or solvent to a predetermined amount of heat (a predetermined temperature or a predetermined range of temperatures) for a predetermined time duration.

Increasing any one or combination of the temperature and the time duration can increase the amount of hydrocarbon fractions that become free. In addition, increasing any one or combination of the temperature and the time duration can increase the proportional amount of light hydrocarbon fractions that become free. Naturally, increasing these operating parameters can increase the costs associated with operating the system, and thus a cost-benefit analysis can be performed. Thus, the heating campaign can be adjusted to adjust the amount and/or molecular weight of hydrocarbon fraction material to be extracted. For instance, the greater the temperature, and the time duration used for the heating campaign, the greater the amount and the greater the molecular weight of hydrocarbon fraction material is driven off as vapor or volatiles. As can be appreciated, one can perform a cost-benefit analysis to determine the optimal heating campaign that would result in a maximum amount of desired molecular weight hydrocarbon fraction material at the minimal cost.

The vapor or volatiles generated during the heating treatment can be directed to the separator. As noted herein, some embodiments use a solvent to generate a solvent solution for, and thus the vapor or volatiles can include a hydrocarbon rich solvent solution. An embodiment of the separator can be configured as a condenser having a tube (inner tube) within a tube (outer tube). The vapor or volatiles can be directed through the inner tube, while coolant (e.g., $H_2O$) is circulated throughout the outer tube. The coolant can cause the vapor or volatiles to cool and condense, which can condense to a liquid. This liquid can contain the resultant extracted material. The types of hydrocarbon fractions (e.g., light, heavy, etc.) and the relative amounts of hydrocarbon fractions within the resultant extracted material will be a function of the base material used, the solvent used, and the operating parameters of the heating treatment.

It should be noted that embodiments of the system and method can be operated without any application of pressure (positive or negative) in the system. While embodiments of the system may be configured to utility pressure, no pressure or vacuum is necessary for effective use of the system. For instance, the vapor and volatiles are driven up through the separator and cool and condense before reaching any vent or opening in the separator. The condensed vapors and volatiles are then collected. Thus, no pressure if necessary for proper and effective operation of the system. This significantly reduces costs and increases safety, and is in stark contrast to conventional systems. In addition, because no vapor or volatiles reach the vent, none of the hydrocarbon fractions have to be vented off (or otherwise escape the system) or flared off. This significantly reduces environmental liability, and is in stark contrast to conventional systems.

As a non-limiting example, the system can be operated at 350° F. for 30 minutes to generate a resultant extracted material having a 25% hydrocarbon extraction yield by weight of hydrocarbon fractions (i.e., if 100 grams of base material is put in the heating vessel, 25 grams of hydrocarbon fractions can be extracted). Thus, the hydrocarbon extraction yield at these operating parameters can be 25%. Test results on this resultant extracted material reveal that 70% of these 25 grams of hydrocarbon fractions are within the range of C1 to C20, and 30% of these 25 grams of hydrocarbon fractions are greater than C20. This type of yield can be referred to as light hydrocarbon fraction extraction yield. Even though light hydrocarbon fractions is defined herein as being within the range from C1 to C14, increasing the percentage of C1 to C20 hydrocarbons in the extracted material will increase the amount of C1 to C14 hydrocarbons, thereby increase the light hydrocarbon extraction yield. As noted above, the heating campaign can be adjusted to adjust the amount and/or molecular weight of the hydrocarbon fractions within the resultant extracted material. Thus, operating temperatures greater than 350° F. and at time durations greater than 30 minutes can result in greater than 25% hydrocarbon extraction yield and/or greater than 70% light hydrocarbon fraction extraction yield.

Another technique that can be used to adjust the hydrocarbon extraction yield and/or the light hydrocarbon fraction extraction yield can be adjusting the mix used as the base material. Some base materials (e.g., LRA crusher fines) can be dryer than others (e.g., drill cuttings). A mixture comprising a combination of a less dry base material and a more dry base material can be used to further adjust the hydrocarbon extraction yield and/or the light hydrocarbon fraction extraction yield. For instance, a greater hydrocarbon extraction yield and/or light hydrocarbon fraction extraction yield can be obtained from a base material that comprises a mixture of LRA crusher fines and drill cuttings, as opposed of a base material consisting of LRA crusher fines only or consisting of drill cuttings only. Without wishing to being limited by theory, it is hypothesized that the mixture provides improved yields because the lighter hydrocarbon fractions in the less dry base material (e.g., the drill cuttings) serve to loosen the hydrocarbon fractions in the more dry base material (e.g., the LRA crusher fine), thereby acting as a solvent for the mixture.

Embodiments of the extraction process can involve using the resultant extraction material in additional process steps. For example, the resultant extraction material can be used in process steps that are used in petroleum refineries.

In addition to methods disclosed herein for tapping and using the resultant extracted material, the methods can be used to treat or condition the base material. Thus, embodiments of the method can be used to generate a post-processed base material and the resultant extracted material, where both are useful products. For instance, as noted herein, base material can be LRA crusher fines, drill cuttings, etc. These types of base material can be used as components of roadway material, an in particular asphalt roadway material. It may be beneficial for the base material being used as a component of roadway material to have certain hydrocarbon fractions extracted therefrom. Thus, while embodiments of the extraction process can involve using the resultant extraction material in additional process steps (e.g., petroleum refinery processes), the post-processed base material can also be used in additional process steps (e.g., asphalt roadway material construction processes).

It should be further noted that using a base material (pre-processing) that is a mixture of LRA crusher fines and drill cuttings can aid in the control of the moisture contents of the drill cuttings (which can be pretty wet) for easier processing. Furthermore, a mixture of LRA crusher fines and drill cuttings (after being processed to have the desired hydrocarbon fractions extracted) generally makes for a better roadway material base component (as opposed to just LRA crusher fines alone or drill cuttings alone) when generating asphalt, which further increases the value of the LRA-drill cutting mix.

It should be understood that modifications to the embodiments disclosed herein can be made to meet a particular set of design criteria. For instance, the number of or configuration of process steps and/or operating parameters may be used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

Therefore, it is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of apparatuses and methods of making and using the same have been discussed and illustrated herein, it is to be distinctly understood that the invention is not limited thereto but may be otherwise variously embodied and practiced within the scope of the following claims.

What is claimed is:

1. A method for extracting hydrocarbon fractions from a material, the method comprising:

subjecting a base material comprising hydrocarbon fractions to an extraction process, the extraction process involving a heating treatment configured to free or loosen hydrocarbon factions from a matrix of the base material, the heating treatment generating vapors and volatiles comprising hydrocarbon fractions within a desired range of molecular weights; and allowing the vapors and volatiles to enter a separator for separating the hydrocarbon fractions having molecular weights with the desired range of molecular weights from other components of the vapors and volatiles to generate a resultant extracted material.

2. The method recited in claim 1, further comprising adjusting the heating treatment to adjust the desired range of molecular weights.

3. The method recited in claim 1, further comprising performing the extraction process in iterations to adjust the desired range of molecular weights.

4. The method recited in claim 1, further comprising adding solvent to the base material to free or loosen hydrocarbon factions from the matrix of the base material.

5. The method recited in claim 1, wherein:

the base material comprises hydrocarbon fractions having molecular weights within a first range;

the resultant extracted material comprises hydrocarbon fractions having molecular weights within a second range; and the first range is greater than the second range.

6. The method recited in claim 5, wherein the first range is from C1 to C60.

7. The method recited in claim 5, wherein the second range is from C1 to C14.

8. The method recited in claim 1, wherein the extraction process does not involve application of positive pressure or negative pressure.

9. The method recited in claim 1, wherein the base material comprises a mix of a dry base material and a wet base material.

10. The method recited in claim 1, further comprising processing the resultant extraction material in a petroleum refinery process.

11. The method recited in claim 1, wherein generating the vapors and volatiles via the heating treatment generates a post-treated base material, and the method further comprises processing the post-treated base material in an asphalt roadway material construction processes.

* * * * *